US008430014B2

(12) United States Patent
Burton

(10) Patent No.: US 8,430,014 B2
(45) Date of Patent: Apr. 30, 2013

(54) ARMORED ATTACK VEHICLE WITH HELMET ASSEMBLY

(76) Inventor: Todd Burton, Fishers, IN (US)

( * ) Notice: Subject to any disclaimer, the term of this patent is extended or adjusted under 35 U.S.C. 154(b) by 67 days.

(21) Appl. No.: 13/113,155

(22) Filed: May 23, 2011

(65) Prior Publication Data

US 2012/0060673 A1 Mar. 15, 2012

Related U.S. Application Data

(60) Provisional application No. 61/347,597, filed on May 24, 2010.

(51) Int. Cl.
*F41F 3/04* (2006.01)
*F41A 23/24* (2006.01)

(52) U.S. Cl.
USPC ..... 89/36.07; 89/36.08; 89/930

(58) Field of Classification Search ..... 89/36.06–36.09
See application file for complete search history.

(56) References Cited

U.S. PATENT DOCUMENTS

| | | | | |
|---|---|---|---|---|
| 5,577,311 | A | 11/1996 | Riddle | |
| 5,792,974 | A | 8/1998 | Daqis et al. | |
| 5,822,836 | A | 10/1998 | Riddle | |
| 6,041,689 | A | 3/2000 | Lair et al. | |
| 6,047,626 | A | 4/2000 | Lair et al. | |
| 6,082,240 | A | 7/2000 | Middione et al. | |
| 6,173,482 | B1 | 1/2001 | Riddle et al. | |
| 7,223,062 | B1 | 5/2007 | Emerson | |
| 7,225,717 | B2 | 6/2007 | Williams | |
| 7,458,306 | B2 | 12/2008 | Singh et al. | |
| 7,520,205 | B1 | 4/2009 | Colliflower et al. | |
| D610,038 | S | 2/2010 | Kiel et al. | |
| 8,205,703 | B2 * | 6/2012 | Halliday | 180/89.1 |
| 2005/0252367 | A1 | 11/2005 | Jilg et al. | |
| 2006/0201319 | A1 | 9/2006 | De Wet | |
| 2007/0000377 | A1 | 1/2007 | Ohnstad | |
| 2007/0017360 | A1 | 1/2007 | Cohen | |
| 2008/0127878 | A1 * | 6/2008 | Marion et al. | 114/337 |
| 2009/0120273 | A1 | 5/2009 | Eckdahl et al. | |
| 2010/0005644 | A1 | 1/2010 | Schneider et al. | |
| 2010/0011948 | A1 | 1/2010 | Johnson et al. | |
| 2010/0024633 | A1 | 2/2010 | Piscitelli | |

(Continued)

OTHER PUBLICATIONS

International Patent Application PCT/US2011/037628 Search Report mailed Feb. 9, 2012.

(Continued)

*Primary Examiner* — Michael David
(74) *Attorney, Agent, or Firm* — Woodard, Emhardt, Moriarty, McNett & Henry LLP

(57) ABSTRACT

Aspects of the present disclosure provide an armored helmet assembly that is fully or completely assembled and quickly mounted onto a host vehicle to form a military vehicle. The armored helmet assembly provides protection, weapons, cameras, and other equipment for the driver. When desired, the armored helmet assembly in a completely assembled state is unlocked and removed from the host vehicle. The host vehicle is typically a construction vehicle and useful as such. In some embodiments, a weapons platform assembly is mounted on the armored helmet assembly. Other embodiments include one or more of an expandable battle shield, a front end container for storage of equipment or weapons, and a command surveillance module. In certain embodiments, in addition to the armored helmet assembly, a lower armored assembly in a completely assembled state is mounted onto a lower portion of the host vehicle.

9 Claims, 31 Drawing Sheets

U.S. PATENT DOCUMENTS

| | | | | |
|---|---|---|---|---|
| 2010/0037761 | A1 | 2/2010 | Boczek et al. | |
| 2010/0071539 | A1 | 3/2010 | Boczek et al. | |
| 2010/0077913 | A1 | 4/2010 | Cunningham et al. | |
| 2012/0181100 | A1* | 7/2012 | Halliday | 180/291 |
| 2012/0240759 | A1* | 9/2012 | Halliday | 89/36.02 |

OTHER PUBLICATIONS

International Patent Application PCT/US2011/037628 Written Opinion mailed Feb. 9, 2012.

* cited by examiner

ARMORED ATTACK VEHICLE WITH HELMET ASSEMBLY

CROSS-REFERENCE TO RELATED APPLICATION

This application claims the benefit of U.S. Provisional Application No. 61/347,597 filed May 24, 2010, which is hereby incorporated by reference.

FIELD OF THE INVENTION

The present invention relates generally to an armored shell assembly configured in a completed assembly that is quickly mountable to a host vehicle to convert the host vehicle into a military vehicle. The armored shell assembly in a completed assembly can also be quickly detached from the military vehicle to reveal the host vehicle.

BACKGROUND OF THE DISCLOSURE

In assault, battle, or hostile situations, the military typically uses tanks, helicopters, and other fighter aircraft. To transport military personnel and equipment, the military often employs humvees, trucks, and other carriers. However, all of these vehicles are limited or restricted to certain types of purposes, generally a tactical or a support use.

Recent military conflicts have been fought in urban environments such that conflicts or battles often take place in cities. This type of battle or hostile environment may require military personnel to investigate and remove threats from buildings, parking garages, bridges, and other structures. However, existing military vehicles are not equipped or configured to perform this task. For example, a tank cannot be used to clear a parking garage or building of threats. Typically, parking garages are not designed for the height clearance required or weight of a tank. As such, military personnel are left to clear parking garages and buildings without vehicle protection or convenience.

Military conflicts have also been fought in various types of terrain, such as swamps, mountains, forest, and coastline to name a few. As can be appreciated, a tank may have some difficulty maneuvering in these environments, for example where the tracks of a heavy tank may get stuck in soft, wet mud or sand. Moreover, the landscape or vegetation can be rather thick and/or overgrown in these areas which can also be a barrier for the tank. Therefore, it is desirable to have a military vehicle that can maneuver over the soft, wet mud or sand and around or through the landscape, vegetation, or rough terrain.

After a skirmish is settled, the military often assist to rebuild a war-torn area. Equipment such as skid steer loaders, compact track loaders, and other construction vehicles are useful, for example to clear any rubble.

Military personal are often employed for humanitarian efforts also. For example, in natural disasters near land coasts, ships pull into a port or harbor and unload supplies for those persons injured by the natural disasters. These ships may also unload equipment to clean up and rebuild the buildings, bridges, roads, and other structures destroyed or damaged. During these humanitarian efforts, the military typically does not need the armed aspects of helicopters, tanks, or fighter aircraft. Instead, the military needs humvees, trucks, and construction vehicles to deliver supplies and clear and rebuild the destroyed structures.

SUMMARY

An armored attack vehicle or military vehicle according to certain preferred embodiments described herein include an armored helmet assembly that is mounted onto a host vehicle and connected to the power systems on that vehicle to convert the host vehicle into a military or convertible vehicle. In one form, a lower armored assembly is mounted to the lower portion of the host vehicle. The illustrated armored helmet assembly provides mounting positions for various types of armaments and additional accessories. For non-military use, the illustrated armored helmet assembly is simply unlocked and lifted from the existing or host vehicle, and the host vehicle is operable for civilian purposes. The ability to utilize the same vehicle in times of war and in times of peace is cost effective.

In some embodiments a convertible vehicle includes an armored helmet assembly that is assembly detachably mounted on a host vehicle to form the convertible vehicle. The armored helmet assembly is configured as a completed assembly. The armored helmet assembly includes a front panel opposite a back panel, and a right side panel opposite a left side panel. The right and left side panels span between the front and back panels and each of the right and left side panels includes one or more mounting points that are configured to retain one or more weapons or accessories. These embodiments include the host vehicle that is useable in both a first state and a second state wherein the first state includes the host vehicle, and the second state includes the armored helmet assembly detachably mounted on the host vehicle to form the convertible vehicle. In some embodiments, a weapon platform assembly can be mounted to the armored helmet assembly wherein the weapon platform assembly includes a plurality of weapon attachment locations and each of the plurality of weapon attachment locations is configured to receive a weapon. The weapon platform assembly can include a central axis such that the weapon platform assembly is configured to revolve about the central axis. In some forms, the weapon platform assembly includes a pair of mounting flanges, and each of the right and left side panels defines a hole sized to receive one of the mounting flanges to mount the weapon platform assembly to the armored helmet assembly. In other forms, the weapon platform assembly includes an extendable arm having an adjustable length that spans between a distal end opposite a proximal end and a camera mounted on the distal end of the extendable arm. The camera is operable to view a line of sight for an operator of the host vehicle, wherein the extendable arm can be lengthened to increase a vertical line of sight for the operator of the host vehicle. Some embodiments include an expandable battle shield having a plurality of interconnected panels wherein the battle shield is mountable to the host vehicle. Additionally, the battle shield has an initial compact shape wherein the plurality of interconnected panels are retracted close to the host vehicle, and the battle shield is expandable to a fully expanded shape wherein the plurality of interconnected panels flare open. Other embodiments include a command surveillance module mounted to the armored helmet assembly wherein the command surveillance module includes at least one of a telescopic vertical tower or a telescopic horizontal arm.

Certain embodiments of the present disclosure provide an armored assembly for mounting on a host vehicle. The host vehicle has an upper body and a lower body wherein the upper body defines a compartment for an operator of the host vehicle and the lower body includes a drive mechanism configured to move the host vehicle. An armored helmet assembly is detachably mounted to the upper body wherein the armored helmet assembly is configured as a completed assembly. The armored helmet assembly includes a front panel opposite a back panel, and a right side panel opposite a left side panel. The right and left side panels span between the front and the back panels, wherein the front, back, right side, and left side panels are arranged to cover the compartment of the upper body. In one embodiment, the host vehicle includes a pair of moveable arms and the right and left side panels are configured to cover the moveable arms of the host vehicle. One embodiment includes a connecting system that includes a pair of pin receivers on each of the arms of the host vehicle and a pair of pin receptacles on each of the right side panel and the left side panel. The connecting system also includes a lug pin that is configured to connect the pin receptacle to the pin receiver to attach the right and left side panels of the armored helmet assembly to the pair of arms of the host vehicle. In another embodiment, a plurality of rings are arranged on the front and back panels wherein each of the plurality of rings is sized to receive one or more devices that are configured to suspend the armored helmet assembly therefrom. In yet another embodiment, a lower armored assembly is detachably mounted to the lower body of the host vehicle. The lower armored assembly is configured as a completed assembly that covers the drive mechanism of the lower body.

Certain other embodiments of the present disclosure include a convertible military vehicle. These embodiments include an armored helmet assembly that is configured as a completed assembly. The armored helmet assembly further includes a front panel opposite a back panel and a right side panel opposite a left side panel. The right and left side panels span between the front and the back panels wherein each of the right and left side panels includes one or more mounting points configured to retain one or more weapons or accessories. These embodiments also include a modified skid steer loader having an armor-plated cockpit and a pair of armor-plated half-tracks wherein the modified skid steer loader is useable in a first state and a second state. The first state includes the modified skid steer loader and the second state includes the armored helmet assembly attached to the modified skid steer loader to form the convertible military vehicle. Additional embodiments include a weapon platform assembly having a plurality of weapon attachment locations wherein each of the plurality of weapon attachment locations is configured to receive a weapon and the weapon platform assembly can be mounted to the armored helmet assembly. Other embodiments include a command surveillance module mounted to the armored helmet assembly wherein the command surveillance module includes at least one of a telescopic vertical tower or a telescopic horizontal arm. Yet other embodiments include a front end container mounted to the modified skid steer loader wherein the front end container has a pair of side panels, a front panel, a rear panel, a top panel, and a bottom panel. The pair of side panels, the front, the rear, the top, and the bottom panels are constructed and arranged to define a compartment sized to carry equipment. The bottom panel includes a plurality of tines configured to clear an obstruction in front of the modified skid steer loader.

Additional embodiments and aspects of the disclosure will become apparent from the description, claims, and drawings herein.

DESCRIPTION OF ILLUSTRATED EMBODIMENTS

Figure 1:
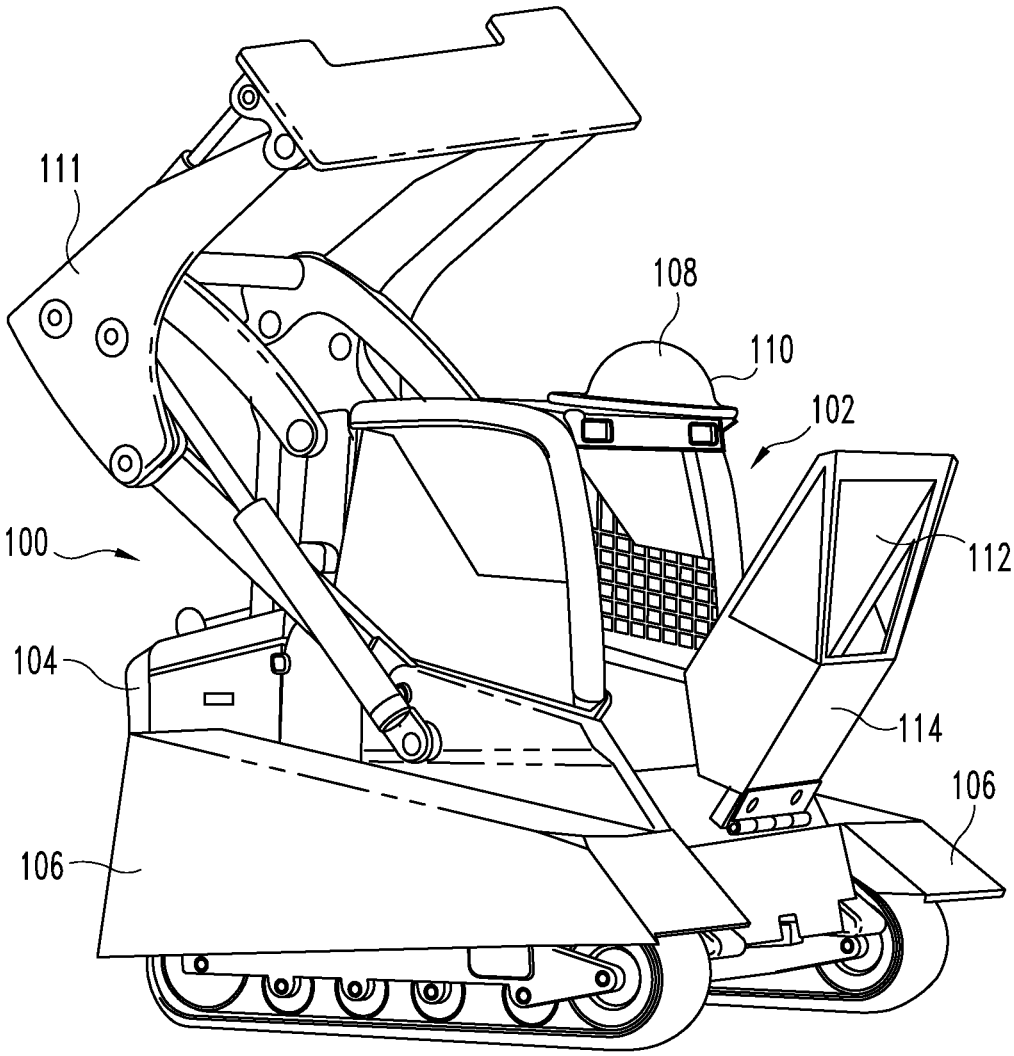
FIG. 1 is a perspective view of a modified track loader according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Aspects of the present disclosure provide an armored helmet assembly that is configured as a complete one-piece body that is lowered onto a host vehicle to convert the host vehicle into a military or convertible vehicle. The host vehicle is typically a construction vehicle and is useful in its unarmored state without the armored helmet assembly mounted thereon. In some embodiments, the armored helmet assembly is sized and configured to fit over and cover an upper portion of the host vehicle. For example, the upper portion of the host vehicle can include a cab or cockpit where the driver or operator of the vehicle would sit. In this embodiment, the armored helmet assembly wraps around the cab of the host vehicle to provide protection against enemy weaponry. Additionally, various weapons, cameras, or other equipment can be attached to the armored helmet assembly as desired.

In some embodiments, a rotating weapons platform assembly is mounted onto the armored helmet assembly. In these embodiments, the rotating weapons platform assembly typically performs at least three functions. First, the rotating weapons platform assembly is configured to provide an operator of the host vehicle a full 360 degree view of the surrounding landscape. Second, the rotating weapons platform assembly is configured to provide an extended height advantage for the operator of the host vehicle wherein the operator is able to see above the line of sight of the cab or cockpit of the host vehicle. Third, the rotating weapons platform assembly is configured to provide multiple weapons attachment locations for weapons, sensors, cameras or the like.

In other embodiments, an expandable battle shield is attached to the front end of the host vehicle to provide additional protection against military weapons as needed. In a closed position, the battle shield is retracted against the host vehicle. In an open or expanded position, the battle shield is configured to flare open to create additional armor to protect the host vehicle.

In another embodiment, a command surveillance module is mounted on the host vehicle. In the illustrated embodiment, the command surveillance module includes a telescopic vertical tower and a telescopic horizontal tower. Each of the towers includes one or more stations that are configured to receive equipment such as cameras, radar detectors, or batteries to name a few examples. The towers are optionally adjustable in length as desired.

In yet another embodiment, an upper armored assembly and a lower armored assembly can be mounted onto the host vehicle to cover and protect the upper and lower portions, respectively, of the host vehicle. In this embodiment, the upper armored assembly is similar to the armored helmet assembly mentioned above.

An example of a host vehicle is a modified daily task machine ("MDTM") or a modified track loader 100 that is illustrated in FIG. 1. In other embodiments, the host vehicle can include other vehicles. Alternative types of vehicles include wheeled loaders, tracked loaders, backhoes, forklifts, excavators, skid steer loaders, tractors, bulldozers, and hydraulic cranes or "cherry pickers", to name a few types. In the illustrated embodiment, the modified track loader 100 includes an armor-plated cockpit 102, an engine 104, a pair of armor-plated half-tracks 106, a target acquisition and designation system 108, a pilot night vision system 110, and a hydraulic bucket or shovel mounted on arms 111. The modified track loader 100 is similar to a skid steer loader, such as a John Deere CT-332 compact track loader; however, the modified track loader 100 optionally includes one or more of the above-mentioned features. The armor-plated cockpit 102 preferably includes bullet-proof glass 112 and armor plating 114.

Figure 2:
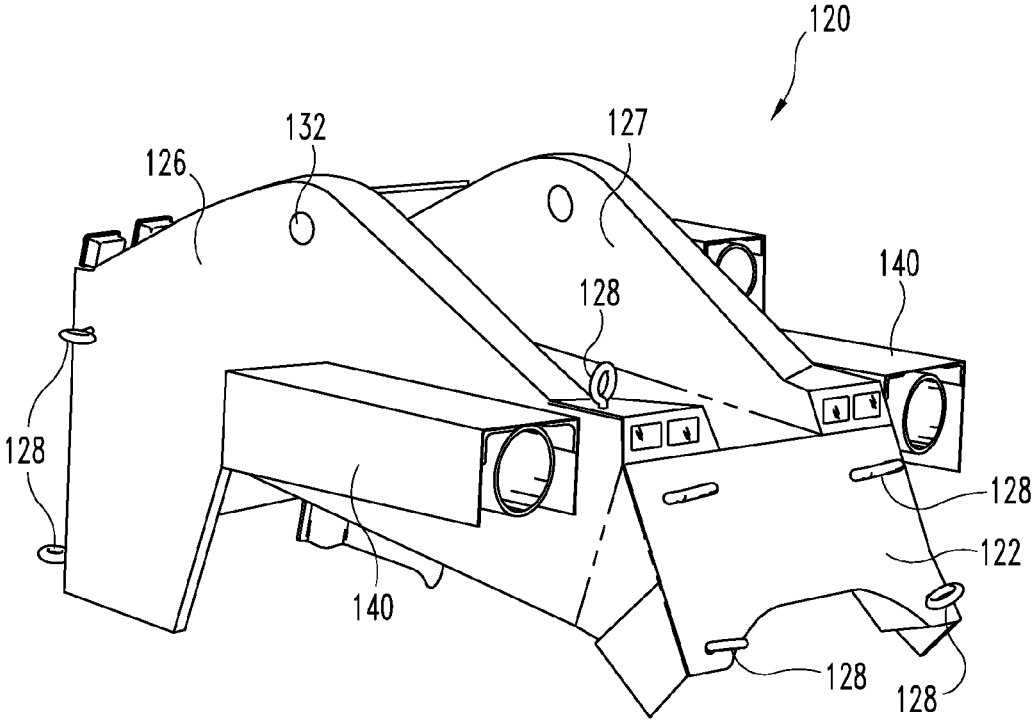
FIG. 2 is a perspective view of an armored helmet assembly according to one embodiment.
Figure 3:
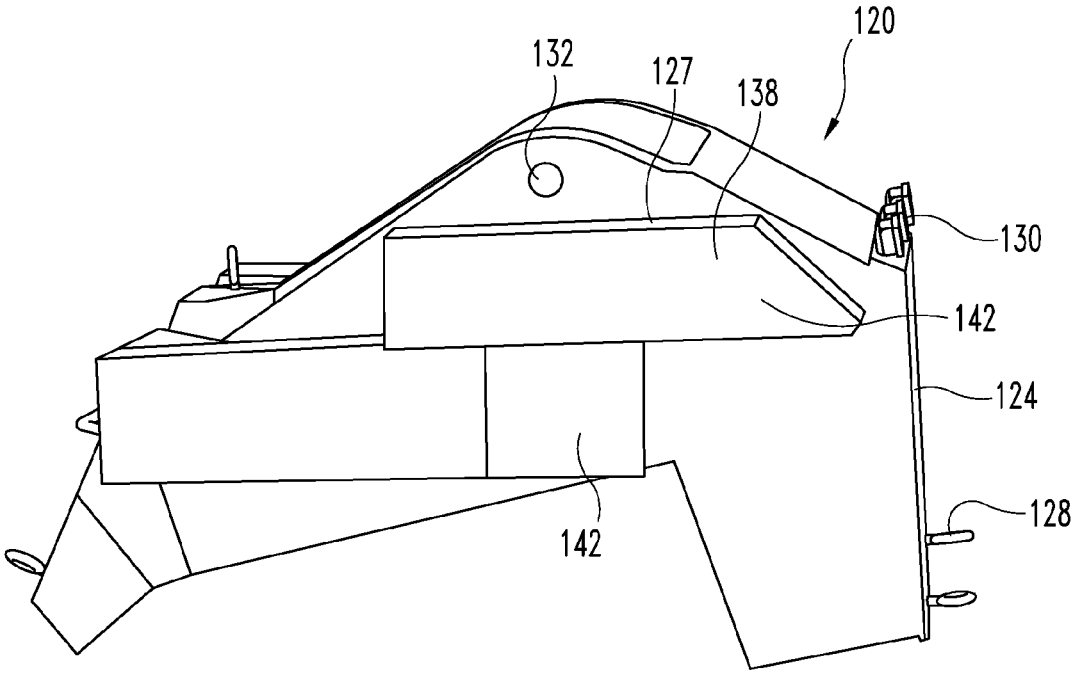
FIG. 3 is a left side view of the FIG. 2 armored helmet assembly.
Figure 4:
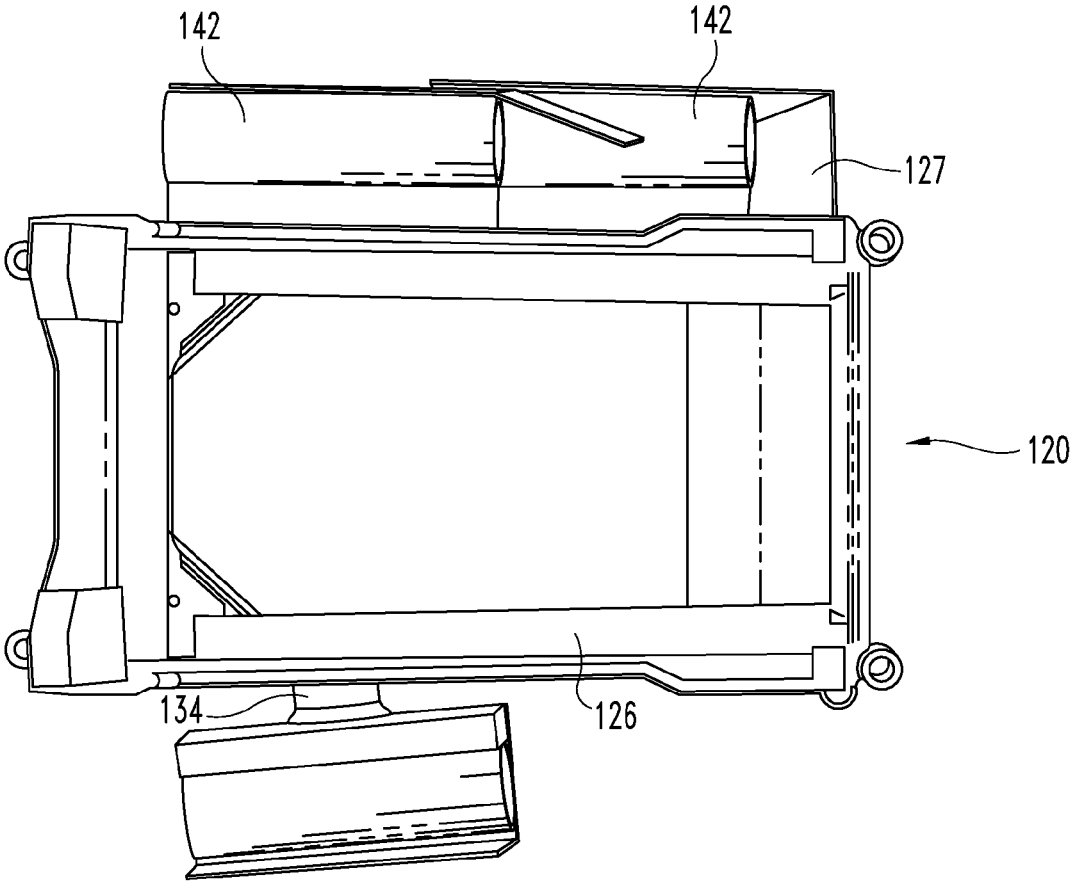
FIG. 4 is a bottom view of the FIG. 2 armored helmet assembly.
Figure 5:
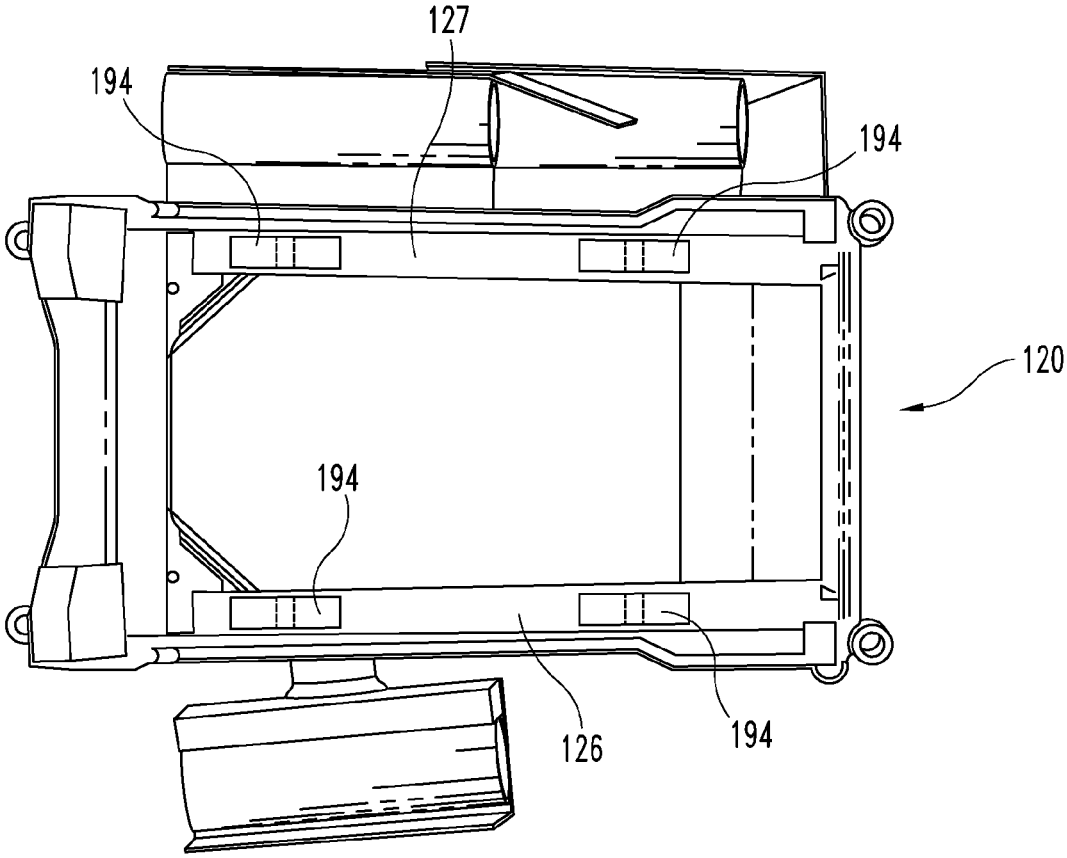
FIG. 5 is a bottom view of the FIG. 2 armored helmet assembly including a plurality of pin receptacles.
Figure 6:
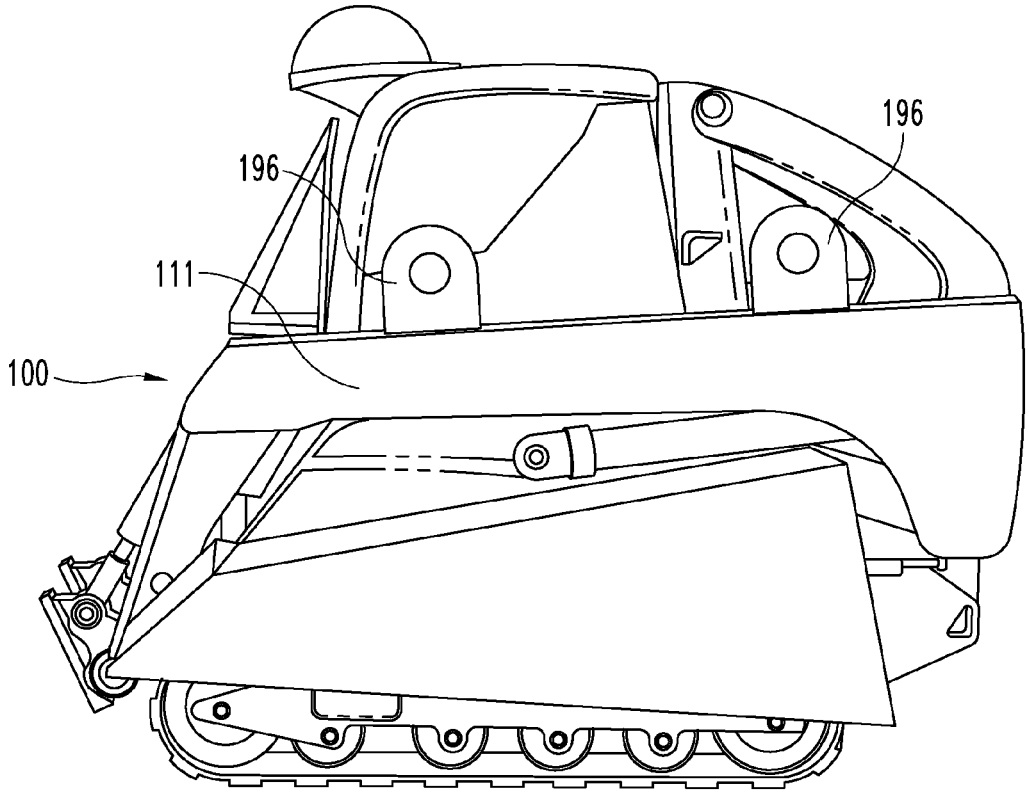
FIG. 6 is a left side view of the FIG. 1 modified track loader including a plurality of pin receivers.
Figure 7:
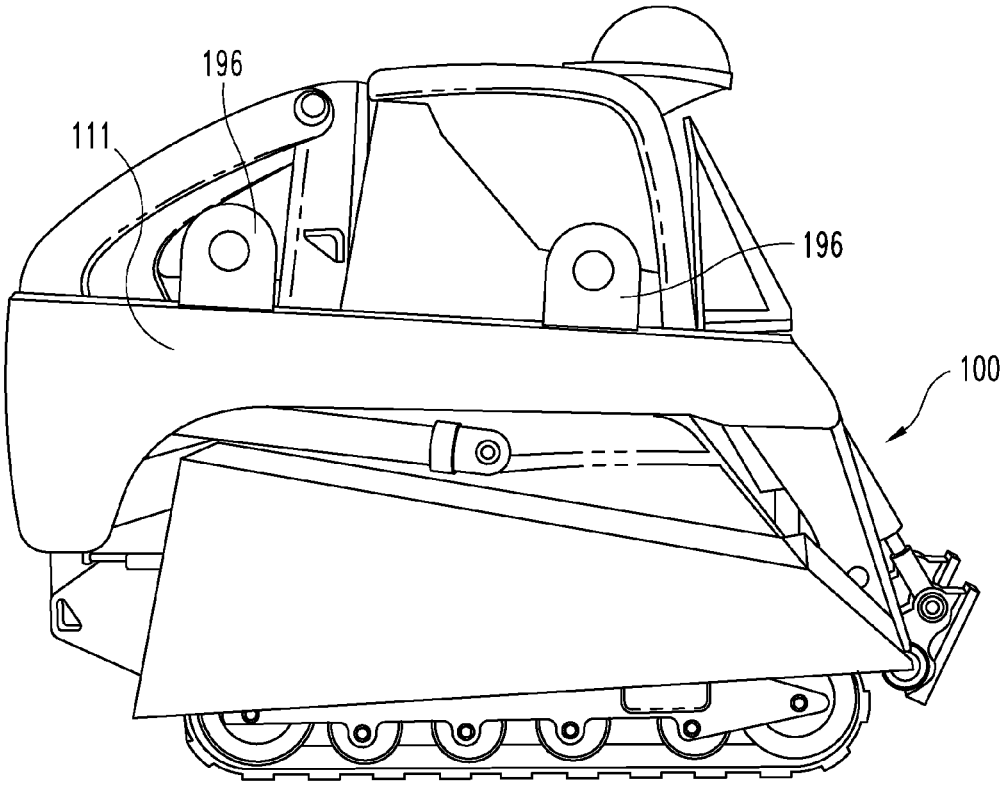
FIG. 7 is a right side view of the FIG. 1 modified track loader including a plurality of pin receivers.
Figure 8:
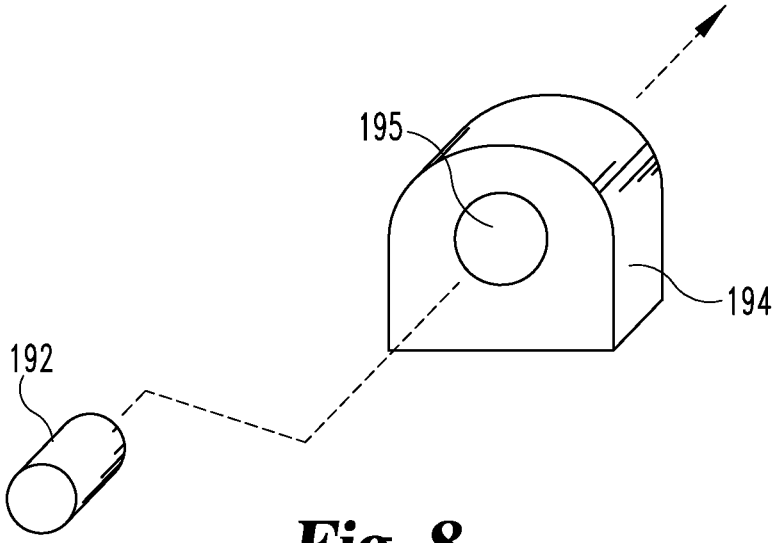
FIG. 8 is a perspective view of one of the pin receptacles from FIG. 5.
Figure 9:
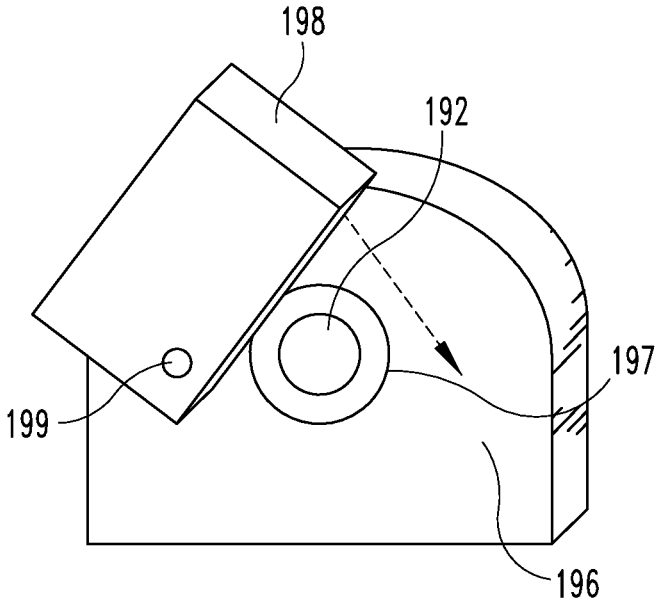
FIG. 9 is a perspective view of one of the pin receivers from FIG. 6.
Figure 10:
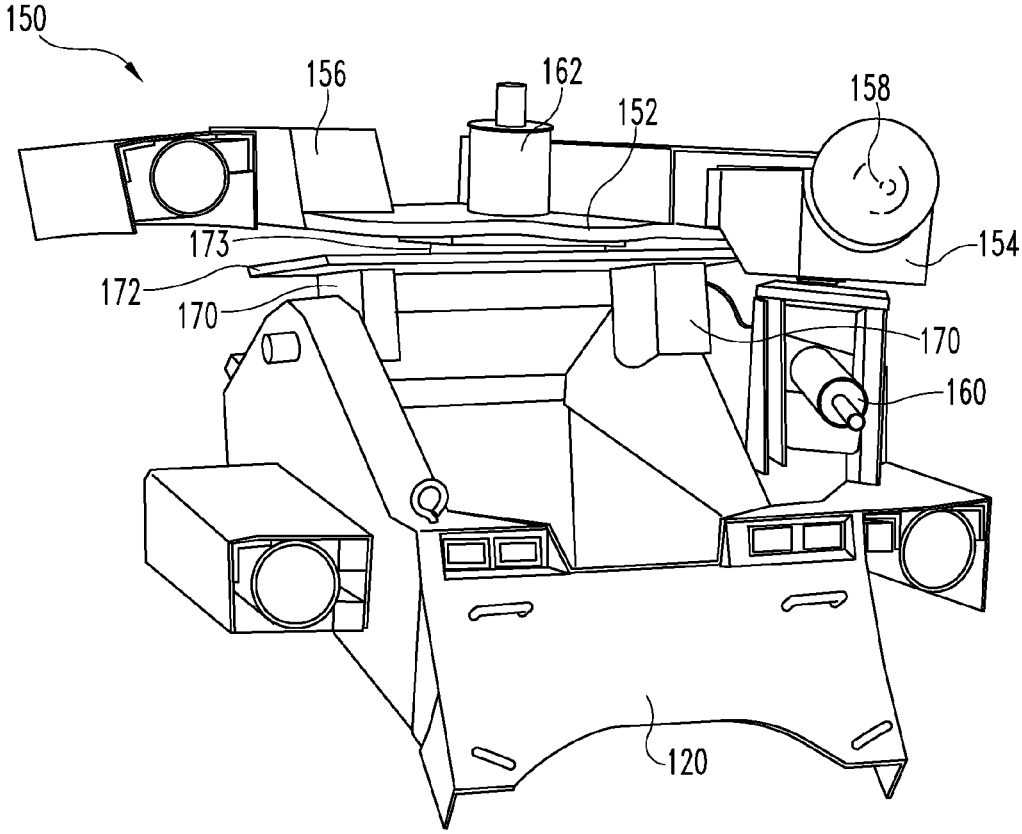
FIG. 10 is a front perspective view of the FIG. 2 armored helmet assembly with a rotating weapons platform assembly attached thereon.
Figure 11:
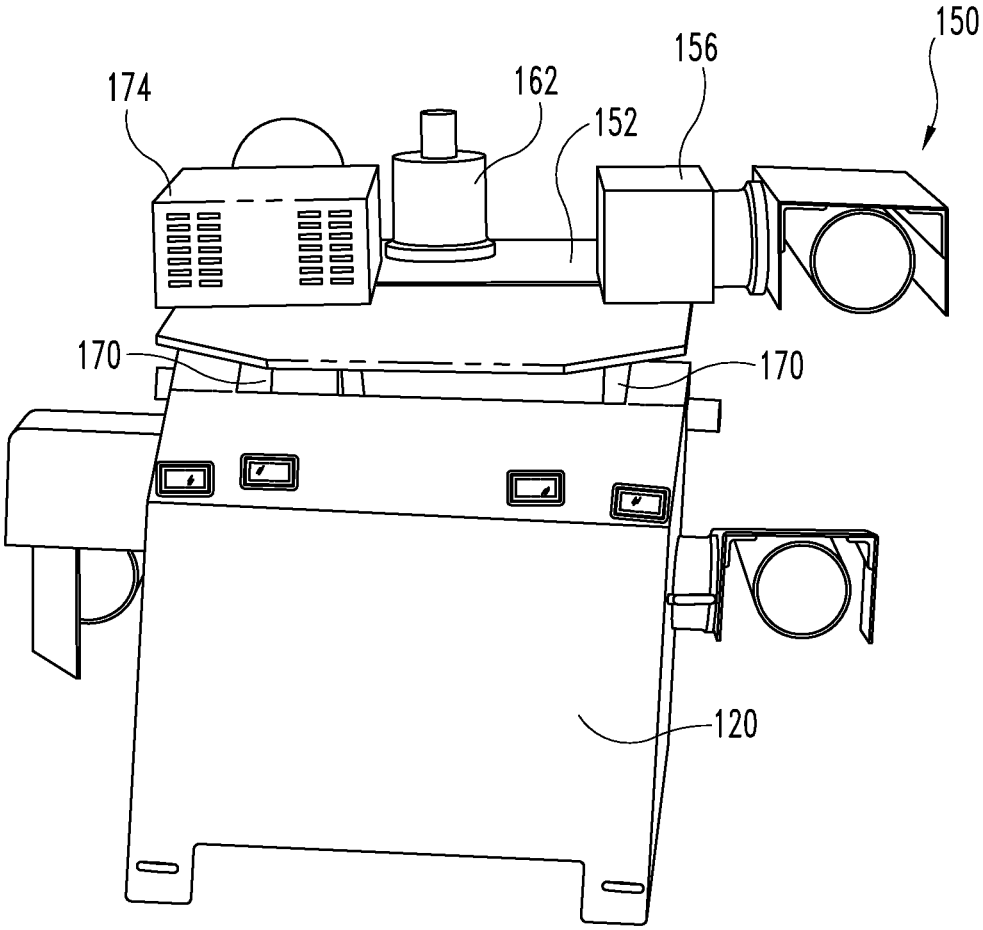
FIG. 11 is a rear view of the FIG. 10 embodiment.

One form of an armored helmet assembly 120 is illustrated in FIGS. 2, 3, and 4. In one embodiment, the armored helmet assembly 120 is connectable to the modified track loader 100 by hard weight-bearing fitting points and with electrical and hydraulic quick disconnect fittings (not illustrated). In another embodiment, the armored helmet assembly 120 is connectable to the modified track loader 100 by inserting a lug pin into a lug pin receiver, as described in more detail below. The armored helmet assembly 120 is configured and arranged to form a protective cover or shell over at least the arms 111 of the modified track loader 100 and in some embodiments the armored helmet assembly 120 is configured to cover the bucket or shovel mounted on the arms 111 of the modified track loader 100. Typically, the modified track loader 100 is a standard size; therefore, one armored helmet assembly 120 is interchangeable for a second armored helmet assembly. For example, if the first armored helmet assembly 120 is damaged, the damaged helmet assembly 120 can be removed from the modified track loader 100 and replaced with a second armored helmet assembly. Thus, the same modified track loader 100 with the second armored helmet assembly can continue working.

In the illustrated embodiment, the armored helmet assembly 120 includes a front panel 122, a back panel 124, a right side panel 126, and a left side panel 127. In other embodiments, the armored helmet assembly 120 is configured differently. For example, the armored helmet assembly 120 may include one or more of the panels 122, 124, 126, and 127. The panels 122, 124, 126, and 127 are arranged to form a base upon which a rotating weapons platform ("RWP") assembly 150 is mounted as described in more detail below. The panels 122, 124, 126, and 127 are sized and arranged to fit over or cover an upper portion of the modified track loader 100 as described next. For example, front panel 122 is configured to fit over and cover a front portion of cockpit 102. Back panel 124 is configured to fit over and cover a portion or all of the rear of the modified track loader 100. The right side panel 126 and the left side panel 127 are each configured to cover and rest on the arms 111. In certain embodiments, the right side panel 126 and left side panel 127 are configured to cover the right and left sides of the cockpit 102.

The front panel 122 and the back panel 124 may include a plurality of rings 128. Preferably, the back panel 124 also has a plurality of lights 130. The plurality of rings 128 are arranged on the panels 122 and 124 such that a chain hook or other device can be attached to the rings 128 to suspend the armored helmet assembly 120 from a rack system, crane, other equipment, or a vehicle to position the armored helmet assembly 120 on the track loader 100 as described in more detail below. The right side panel 126 and the left side panel 127 each define a hole 132 that is shaped to receive a portion of an RWP assembly 150. In other embodiments, each of the side panels 126 and 127 includes a different mechanism, such as a groove, a bracket, a track, or some other mechanism, that connects with a portion of the RWP assembly 150 to attach the RWP assembly 150 to the armored helmet assembly 120.

Optionally, right side panel 126 includes a bracket 134 upon which a rocket launcher 140 is mounted. In the illustrated embodiment, left side panel 127 includes a housing 138 that is constructed and arranged to receive the rocket launcher 140. The housing 138 has a pair of compartments 142, each of the compartments 142 is sized to receive the rocket launcher 140. In one embodiment, the rocket launcher 140 is a 19 round, 2¾ inch FFAR rocket launcher of the type commonly used on an Apache helicopter. In other embodiments, the right side panel 126 and the left side panel 127 are configured to hold other types of firepower, such as A9 Sidewinder missiles, the Hellfire AGM-114A missiles, or the Javelin missiles.

As mentioned above, the armored helmet assembly 120 is connectable to the modified track loader 100 by various connecting systems. One embodiment of a connecting system is illustrated in FIGS. 5, 6, 7, 8, and 9. The connecting system includes a pair of pin receptacles 194 mounted on the right side panel 126 and the left side panel 127 of the armored helmet assembly 120. The connecting system also includes a pair of pin receivers 196 mounted on each of the arms 111 of the modified track loader 100. The connecting system also includes one or more lug pins 192 that connect the pin receptacles 194 of the armored helmet assembly 120 to the pin receivers 196 of the modified track loader 100.

Each of the pin receptacles 194 is spaced a distance apart from each other. Each of the pair of pin receptacles 194 defines a pin opening 195 sized to receive a lug pin 192. Similarly, each of the pair of pin receivers 196 defines a pin opening 197 sized to receive lug pin 192. In the illustrated form, each of the pair of pin receivers 196 also includes a pin keeper 198 attached thereon by a hinge pin 199. Each of the pin receivers 196 is spaced a distance apart from each other; however, the distance between the pin receivers 196 and the pin receptacles 194 is about the same such that the pin opening 195 aligns with the pin opening 197 when the armored helmet assembly 120 is mounted on the track loader 100 to enable the lug pin 192 to pass through both pin openings 195 and 197. The lug pin 192 has a length that is long enough to fit through both the pin receptacle 194 and the pin receiver 196 to thereby connect the armored helmet assembly 120 to the modified track loader 100. After the armored helmet assembly 120 is assembled to the track loader 100, the lug pin 192 is inserted through pin openings 195 and 197 and the pin keeper 198 is rotated about the hinge pin 199 to cover and retain the lug pin 192 in the pin openings 195 and 197. In other embodiments, the lug pin 192 is configured differently. For example, the lug pin 192 may be a bolt configured to receive a nut to retain the lug pin 192 in the pin openings 195 and 197.

One embodiment of an RWP assembly 150 is illustrated in FIGS. 10, 11, 12, and 13. The RWP assembly 150 provides tank-like range of motion with comparable firepower for the compact modified track loader 100 where a tank could not travel. The RWP assembly 150 includes a weapons platform field adjuster 152 upon which an extending arm gun system 154 and a rear weapons attachment center 156 are mounted. The extending arm gun system 154 includes a camera system 158 and a front weapons attachment center 160. The RWP assembly 150 has an upper rotating weapons attachment center 162 mounted on the weapons platform field adjuster 152 such that the attachment center 162 is constructed and arranged to receive additional weapons, cameras, and pilot night vision sensors, as described in more detail below. The RWP assembly 150 includes a portion that connects with the armored helmet assembly 120. In one form, the RWP assembly 150 includes a pair of arms or mounting flanges 170 that are adjustably connected to a beam 172. The weapons platform field adjuster 152 is rotatably mounted on the beam 172 via a turntable system 173. In one form, the turntable system 173 is mounted on a central axis on beam 172. The weapons platform field adjuster 152 is described in more detail below. The extending arm gun system 154 includes a motor (not illustrated) to drive and extend the arm portion of the gun system 154. In one form, the RWP assembly 150 has a ventilation housing 174 positioned near the motor of the extending arm gun system 154.

The RWP assembly 150 performs at least three functions. The first function provides a user a full view of the surrounding landscape and persons as the turntable system 173 enables the weapons platform field adjuster 152 to rotate 360 degrees.

Figure 12:
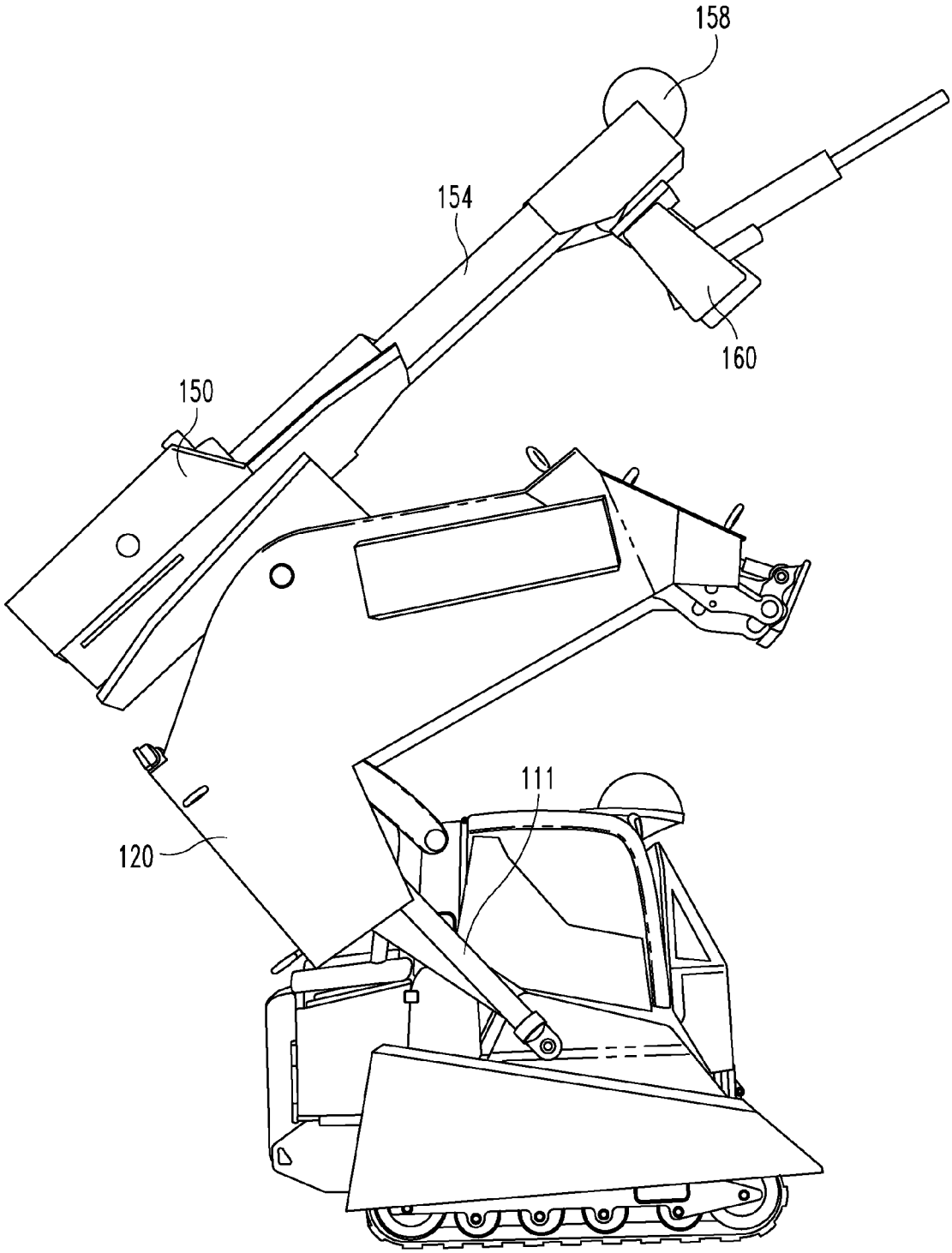
FIG. 12 is a side view of one embodiment of a modified track loader with one embodiment of an armored helmet assembly and one embodiment of the rotating weapons platform assembly mounted thereon, the armored helmet assembly and rotating weapons platform assembly are in a raised configuration.
Figure 13:
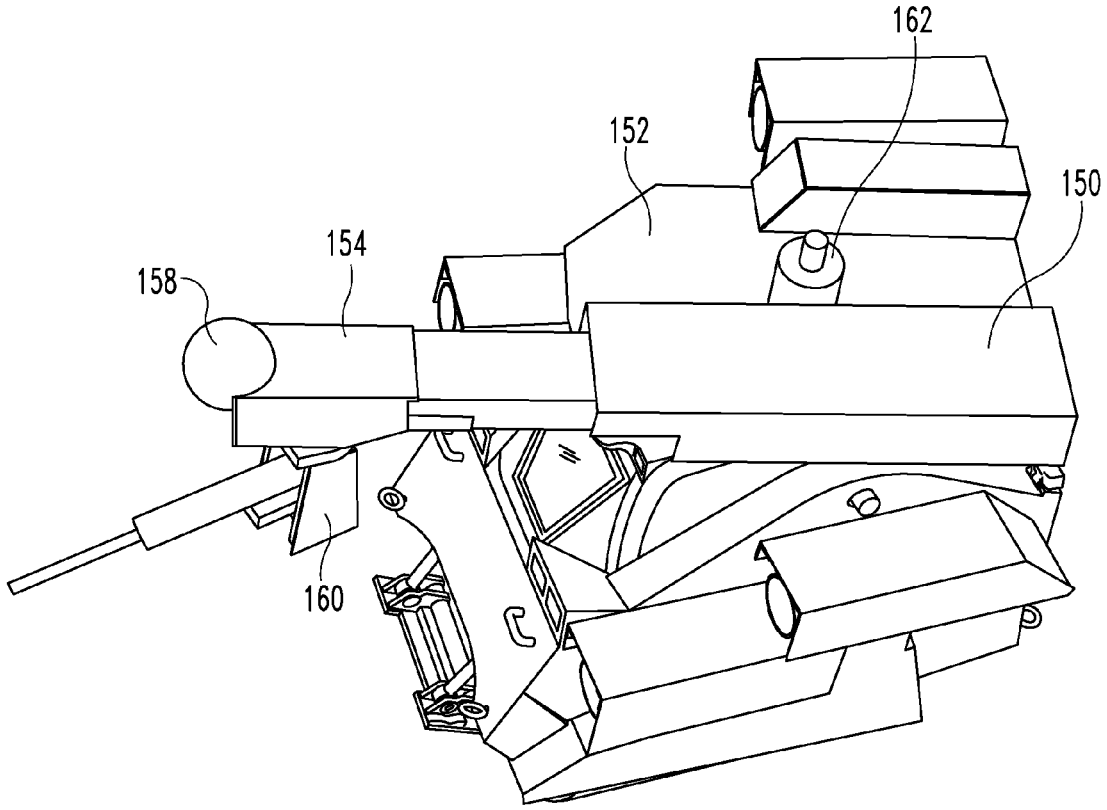
FIG. 13 is a top perspective view of one embodiment of an extending arm gun assembly attached to the rotating weapons platform assembly.

The second function provides an extended height advantage of the front weapons attachment center 160 and the camera system 158. As illustrated in FIG. 12, the extending arm gun system 154 is in a fully extended position and the hydraulic bucket or shovel mounted on arms 111 is raised above the modified track loader 100. As a result of the fully extended position of the gun system 154 and the raised hydraulic bucket mounted on arms 111, a line of sight for the front weapons attachment center 160 is up to about 17 feet and a line of sight for the camera system 158 is up to about 20 feet above the surface upon which the modified track loader 100 rests. The extending arm gun system 154 gives the operator firepower as well as a line of sight over and above obstacles while maintaining a safe distance and elevation from a possible return line of fire. The extending arm gun system 154 can also level off and adjust for deployment of weapons. Beneficially, this configuration allows the driver of the modified track loader 100 to see into a second floor window, over obstacles, and around corners without leaving the armor-plated cockpit 102.

The third function of the RWP assembly 150 is multiple weapons attachment locations where any type of weapon, camera, and/or pilot night vision sensor can be attached. The modularity of assembling any type of weapon, camera, pilot night vision sensor, and/or attachment at any location further customizes the modified track loader 100. For example, as mentioned previously, the RWP assembly 150 includes the rear weapons attachment center 156, the front weapons attachment center 160 on the extending arm gun system 154, and the upper rotating weapons attachment center 162. Any of these attachment centers can be modified to receive various types of weapons or attachments to customize the RWP assembly 150 for any situation.

Figure 14:
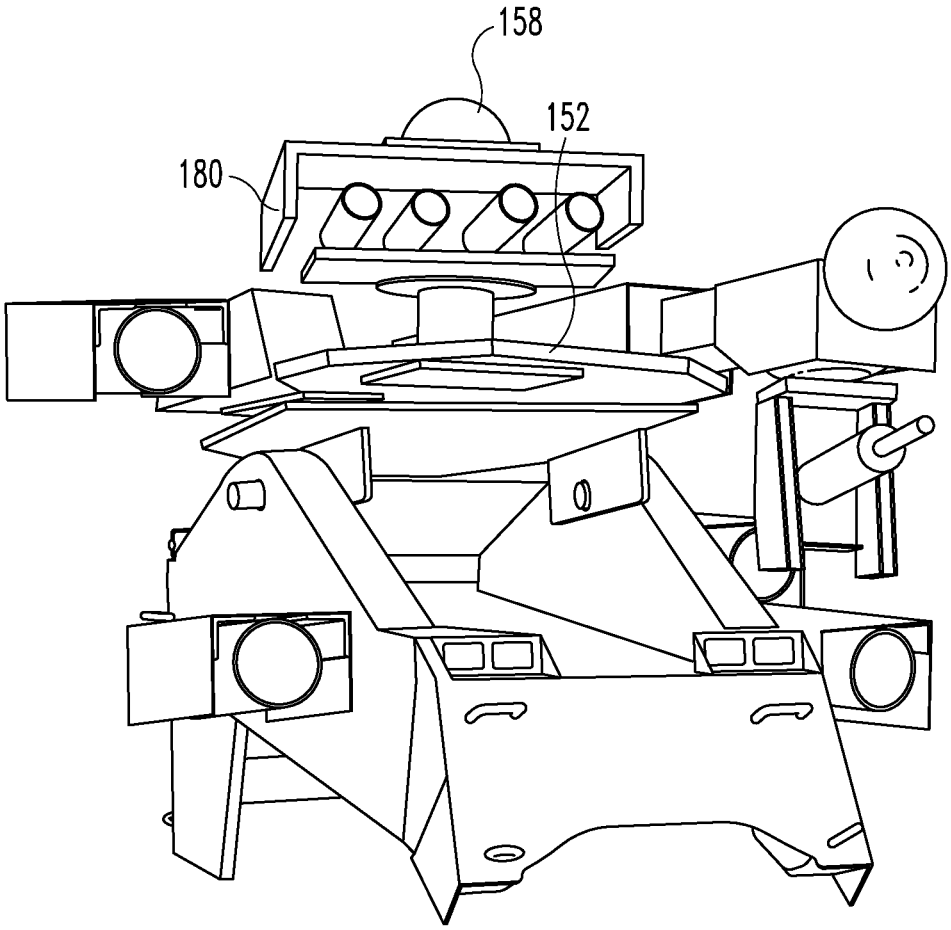
FIG. 14 is a front perspective view of one embodiment of an armored helmet assembly and a rotating weapons platform assembly mounted thereon.
Figure 15:
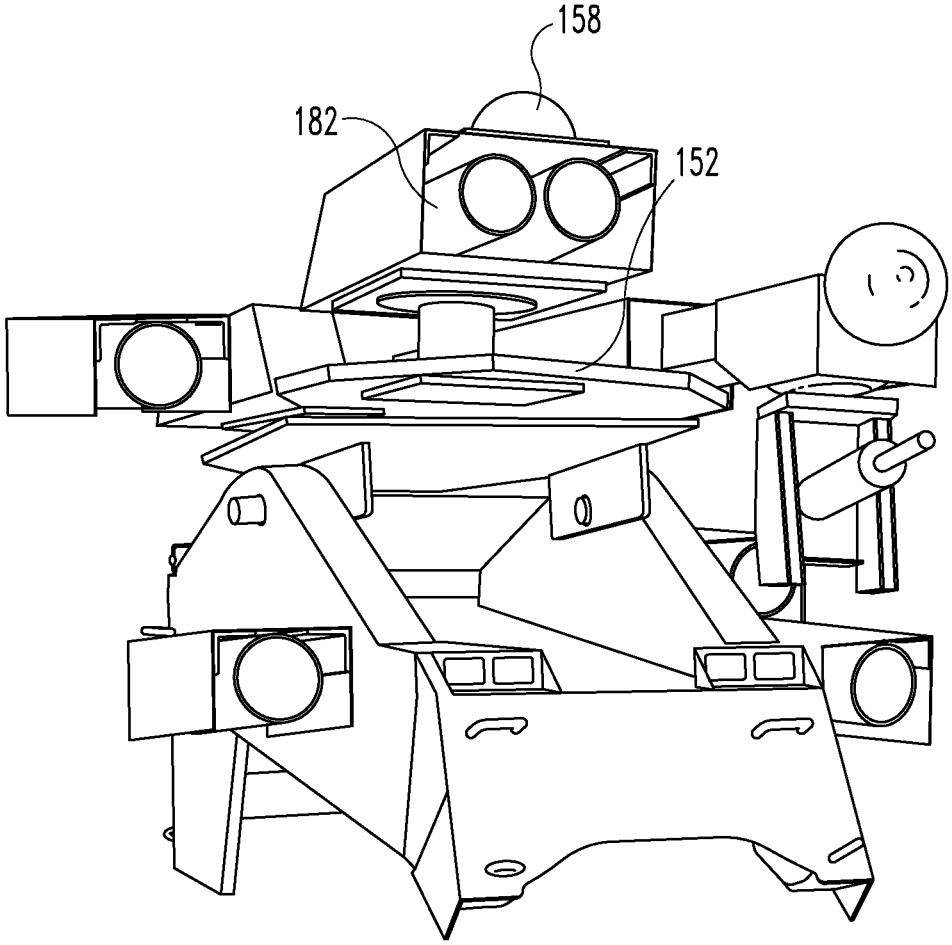
FIG. 15 is a front perspective view of another embodiment of an armored helmet assembly and a rotating weapons platform assembly mounted thereon.
Figure 16:
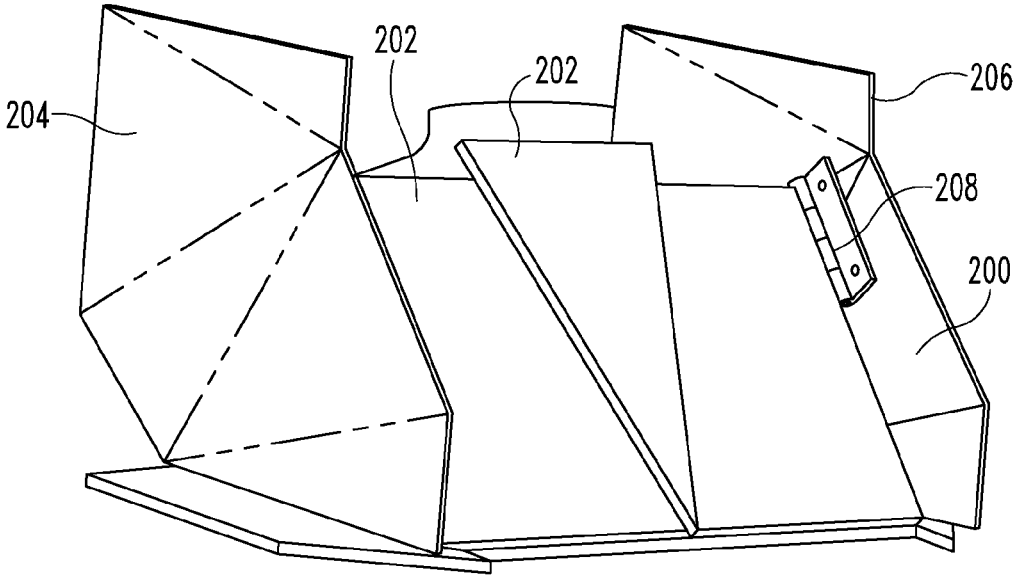
FIG. 16 is a front perspective view of one embodiment of a battle shield in a closed position.
Figure 17:
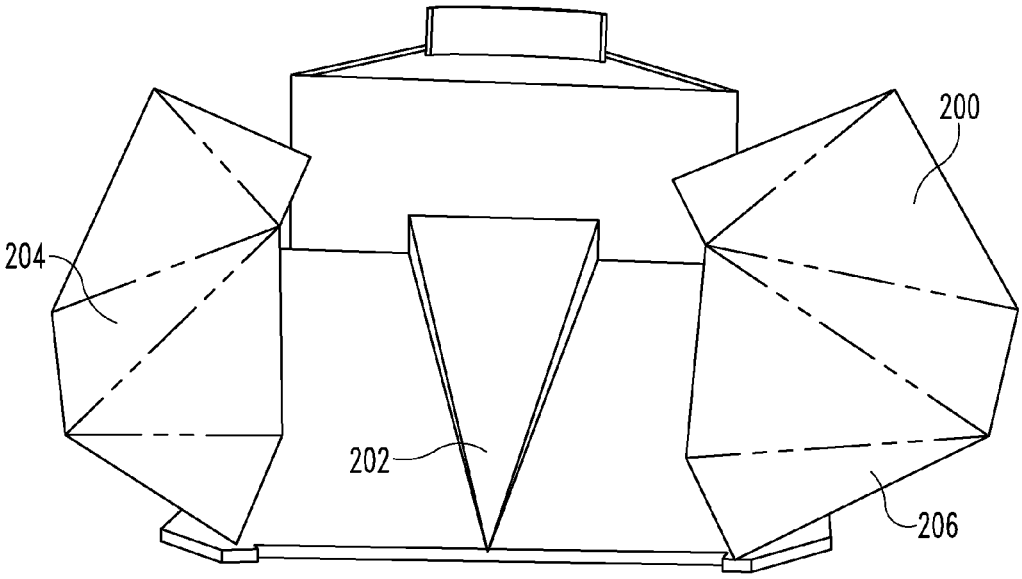
FIG. 17 is a front view of the FIG. 16 embodiment in an open position.
Figure 18:
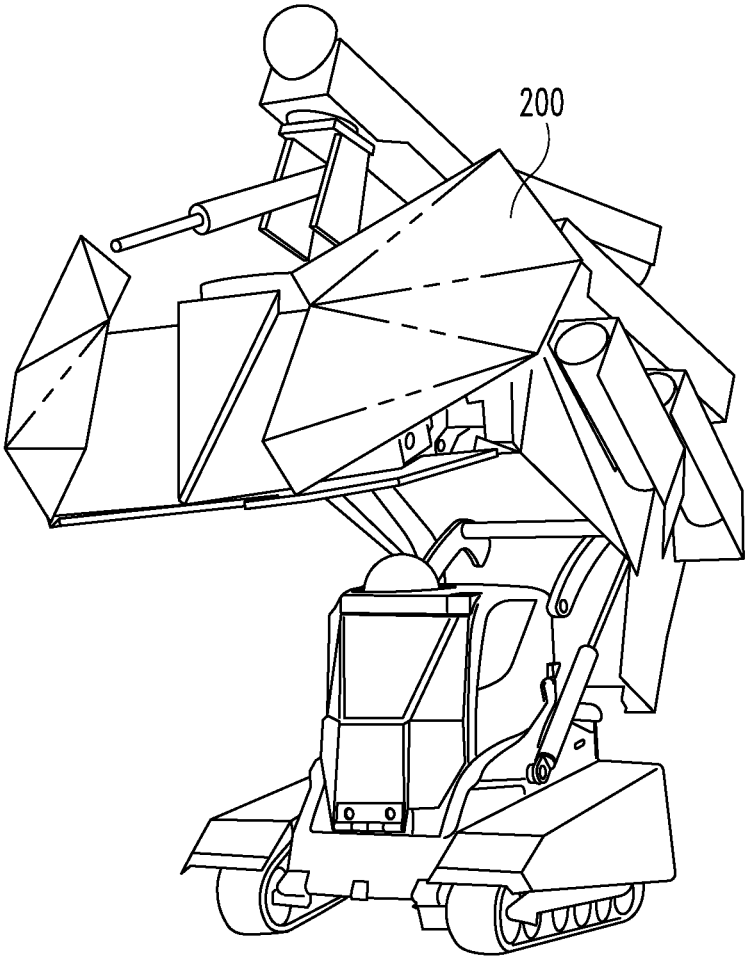
FIG. 18 is a front perspective view of one embodiment of a modified track loader with the battle shield from FIG. 17 in a raised battle position.
Figure 19:
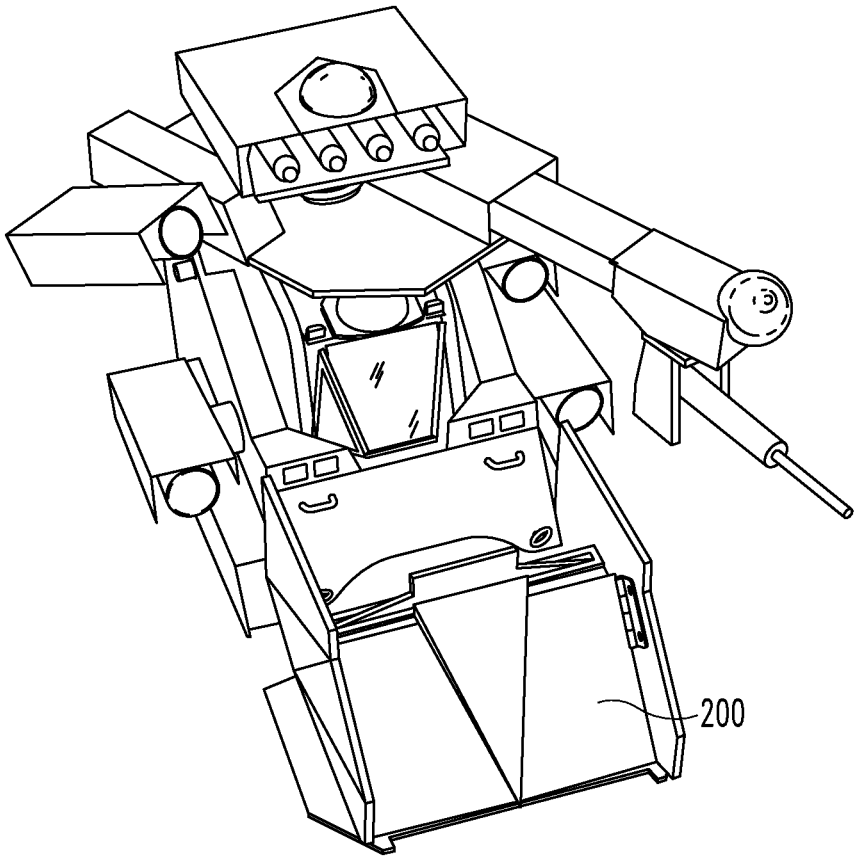
FIG. 19 is another embodiment of a modified track loader with the battle shield from FIG. 16.

The weapons platform field adjuster 152 provides another location for attachment of additional weapons, cameras, a designation sight/pilot night vision sensor, and other equipment. For example, the camera system 158 and a sidewinder missile system 180 are attached to the weapons platform field adjuster 152 as illustrated in FIG. 14. In another embodiment, the camera system 158 and an upper rocket launcher 182 are attached to the weapons platform field adjuster 152 as illustrated in FIG. 15.

One embodiment of the modified track loader 100 includes a battle shield 200 as illustrated in FIGS. 16, 17, 18, and 19. The battle shield 200 includes a plurality of front panels 202, a plurality of right side panels 204, and a plurality of left side panels 206. The plurality of right side panels 204 is similar to the plurality of left side panels 206. Each of the plurality of right side panels 204 has a triangular shape and each of the panels 204 is positioned adjacent another panel. In one form, the plurality of right side panels 204 is connected to one another to form a folding-fan configuration. Similarly, the plurality of left side panels 206 can be connected to one another. In another form the plurality of right side panels 204 and the plurality of left side panels 206 are hydraulically inflatable and can expand to create additional armor as fluid is pumped into the panels 204 and 206. The battle shield 200 is configured to attach or mount to the bucket or shovel connected to arms 111 of the modified track loader 100.

In a closed position, the plurality of right side panels 204 and the plurality of left side panels 206 are retracted and rest against the hydraulic bucket or shovel mounted on arms 111 to streamline the front end of the modified track loader 100. In an open position, the plurality of right side panels 204 and the plurality of left side panels 206 flare open and extend from the plurality of front panels 202 at an angle. The angle between the plurality of right side panels 204 and the plurality of front panels 202 can vary between about 20 degrees to about 60 degrees. Similarly, the angle between the plurality of left side panels 206 and the plurality of front panels 202 can vary. In the illustrated embodiment, the battle shield 200 includes one or more hinge joints 208 between the plurality of left side panels 206 and the plurality of front panels 202 and similarly one or more hinge joints 208 between the plurality of right side panels 204 and the plurality of front panels 202. Hinge joints 208 are configured to lock in any position to enable the plurality of right side panels 204 or the plurality of left side panels 206 to extend from the plurality of front panels 202 at any angle. As such, the plurality of right side panels 204 and the plurality of left side panels 206 flank the plurality of front panels 202 at some angle to form a shield of armor in front of the modified track loader 100 as an additional layer of protection. Other embodiments of the battle shield 200 include other mechanisms to adjust the position of the plurality of right side panels 204 or the plurality of left side panels 206 with respect to the plurality of front panels 202.

Figure 20:
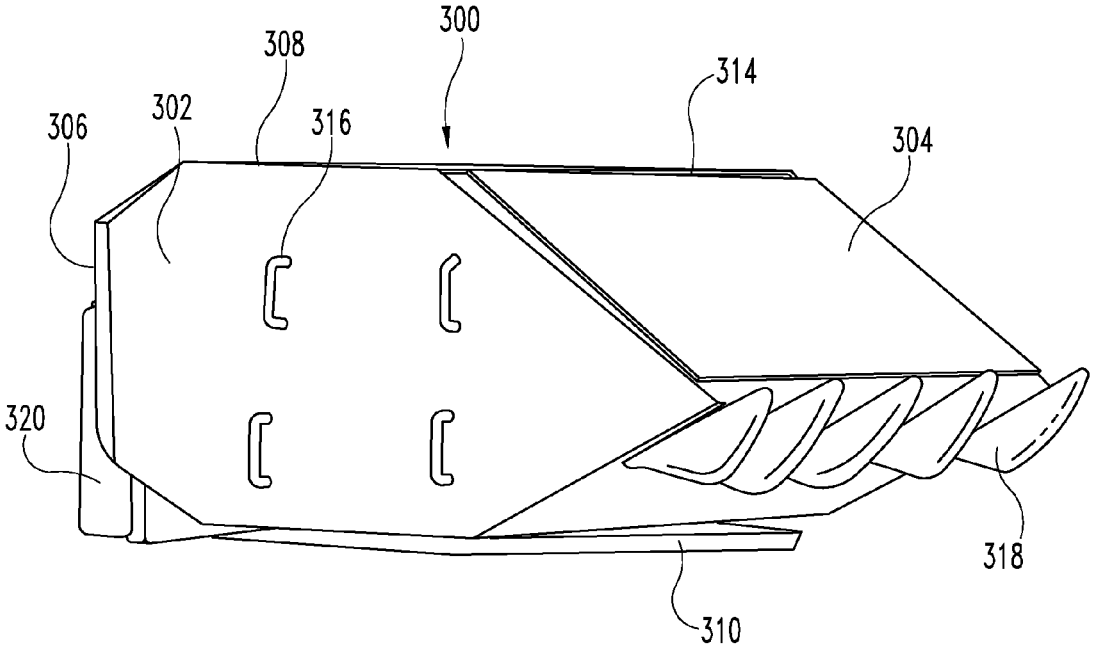
FIG. 20 is a side perspective view of a front end container in a closed position.
Figure 21:
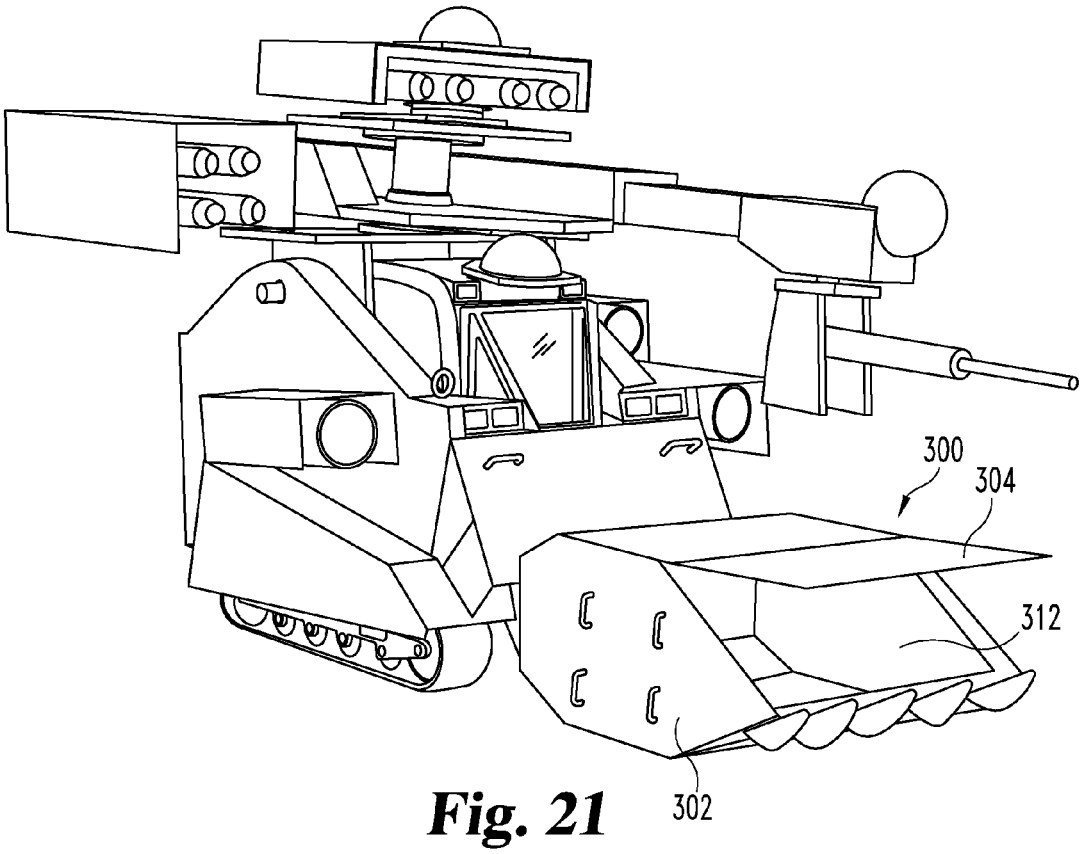
FIG. 21 is another embodiment of a modified track loader with the FIG. 20 embodiment.

One embodiment of the modified track loader 100 includes a front end attachment or container 300 as illustrated in FIGS. 20 and 21. The front end attachment or container 300 includes a pair of side panels 302, a front panel 304, a rear panel 306, a top panel 308, and a bottom panel 310. The front end container 300 also defines a compartment 312. The compartment 312 is sized to carry and conceal equipment, additional firepower, or other devices. The front panel 304 is connected to the top panel 308 via a hinge system 314. One or both of the pair of side panels 302 includes a plurality of ladder attachments 316. The bottom panel 310 includes a plurality of tines 318 for clearing obstacles in front of the modified track loader 100. The rear panel 306 has an attachment mechanism 320 that enables the front end attachment 300 to connect with the hydraulic bucket or shovel mounted on arms 111.

Figure 22:
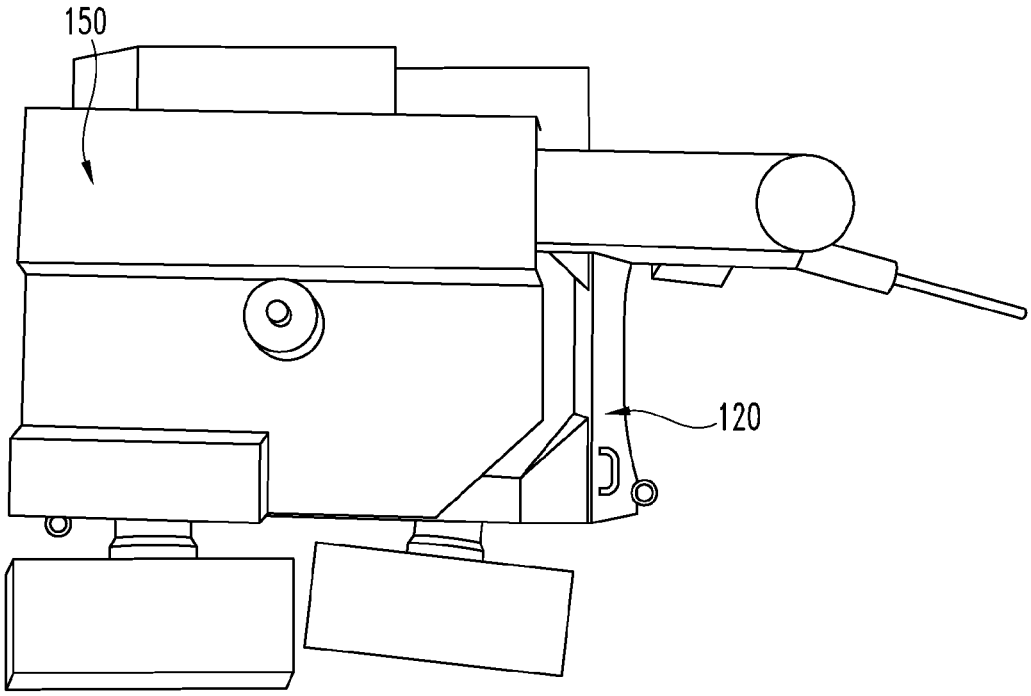
FIG. 22 is a top view of one embodiment of the rotating weapons platform assembly.
Figure 23:
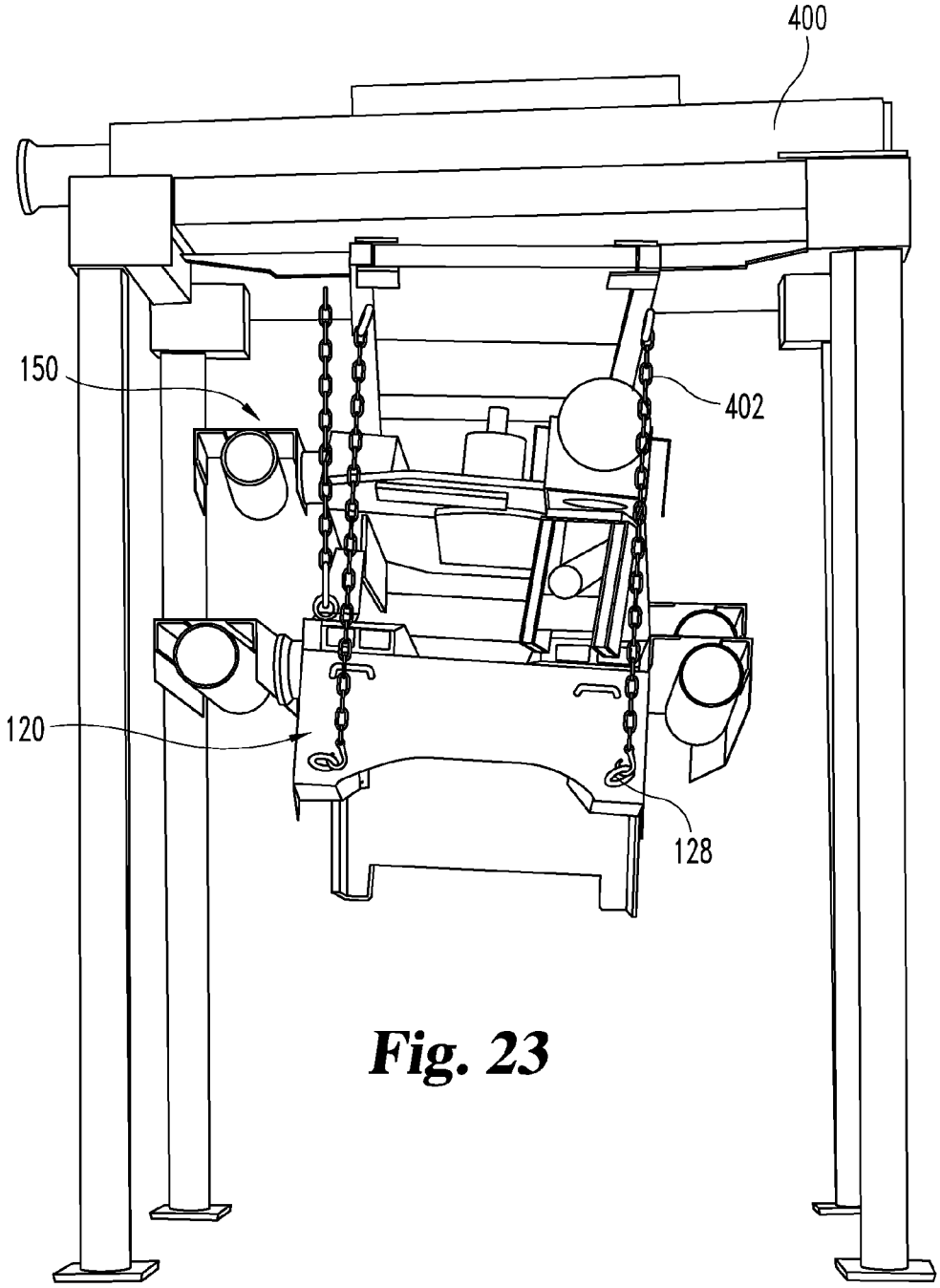
FIG. 23 is a front view of a rotating weapons platform assembly mounted on an armored helmet assembly in a rack system.

One embodiment of the RWP assembly 150 attached to the armored helmet assembly 120 is illustrated in FIG. 22. The RWP assembly 150 attached to the armored helmet assembly 120 is shown suspended from a rack system 400 in FIG. 23. Rack system 400 includes one or more chains 402 that connect with the plurality of rings 128 to hang the RWP assembly 150 and the armored helmet assembly 120 from the rack system 400. To mount the RWP assembly 150 and helmet assembly 120 to the MDTM, the modified track loader 100 is positioned under the rack system 400, and the RWP assembly 150 and the armored helmet assembly 120 are lowered onto and connected to the track loader 100. The modified track loader 100 is thus transformed into a military vehicle equipped with firepower comparable to the Apache-level helicopter for combat. In another form, the RWP assembly 150 attached to the armored helmet assembly 120 is suspended from a crane on another vehicle or a boat. In yet another embodiment, the RWP assembly 150 and the armored helmet assembly 120 are loaded onto a truck and transported to the modified track loader 100 and mounted on-site.

A specific RWP assembly 150 attached to the armored helmet assembly 120 is preferably interchangeable with alternate RWP assemblies attached to alternate armored helmet assembly 120. In other words, a first RWP assembly 150 can be replaced with a second RWP assembly and similarly a first armored helmet assembly 120 can be replaced with a second armored helmet assembly. The interchangeability of the RWP assemblies, the armored helmet assemblies, and weapons, camera system, and pilot night vision sensors mounted on an RWP assembly and/or armored helmet assembly increases the modularity and convertibility of the modified track loader 100. Since an RWP assembly, armored helmet assembly, and the weapons, camera systems, and pilot night vision sensors are quickly and easily removed from the modified track loader 100, the modified track loader 100 has the option to be configured for multiple purposes. In other words, the modified track loader 100 can be used for civilian purposes without the RWP assembly 150 and the armored helmet assembly 120, converted or configured to military use with the RWP assembly 150 and the armored helmet assembly 120, and then reconverted to civilian use again as the RWP assembly 150 and the armored helmet assembly 120 are removed. Moreover, if the RWP assembly 150, the armored helmet assembly 120, and/or the various attachments are damaged or a new configuration is desired, then these components can be easily and quickly changed with new assemblies 150, 120, and various attachments. As another example, various configurations of RWP assembly 150 and armored helmet assembly 120 can be maintained, each including mission-specific weapon, camera system, and/or sensor configurations. Optionally, ammunition and/or rocket pods can be quickly replenished by replacing the appropriate module on the RWP assembly 150 and/or armored helmet assembly 120.

Figure 24:
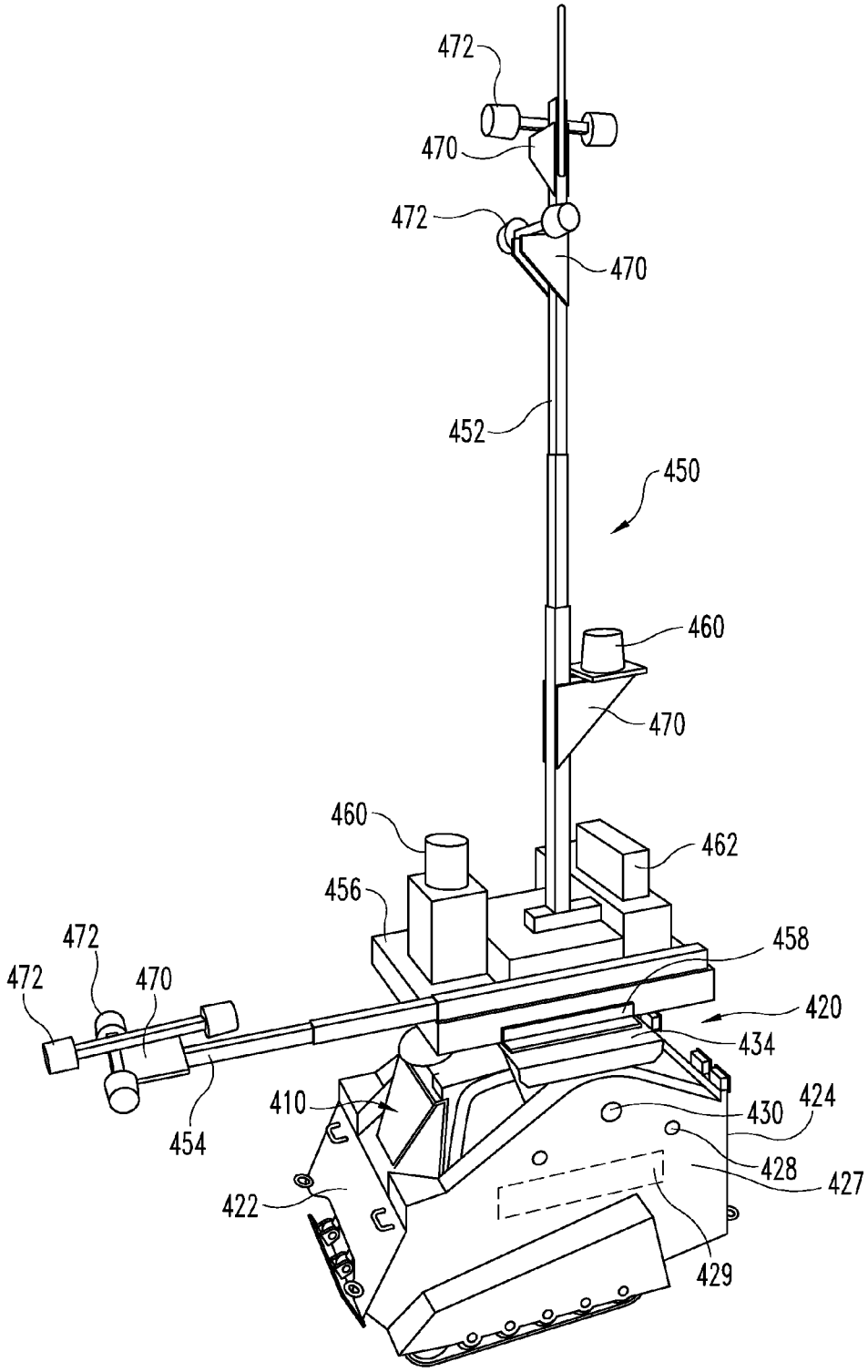
FIG. 24 is a perspective view of one embodiment of a modified track loader with one embodiment of an armored helmet assembly and one embodiment of a command surveillance module mounted thereon, the command surveillance module is in a raised configuration.
Figure 25:
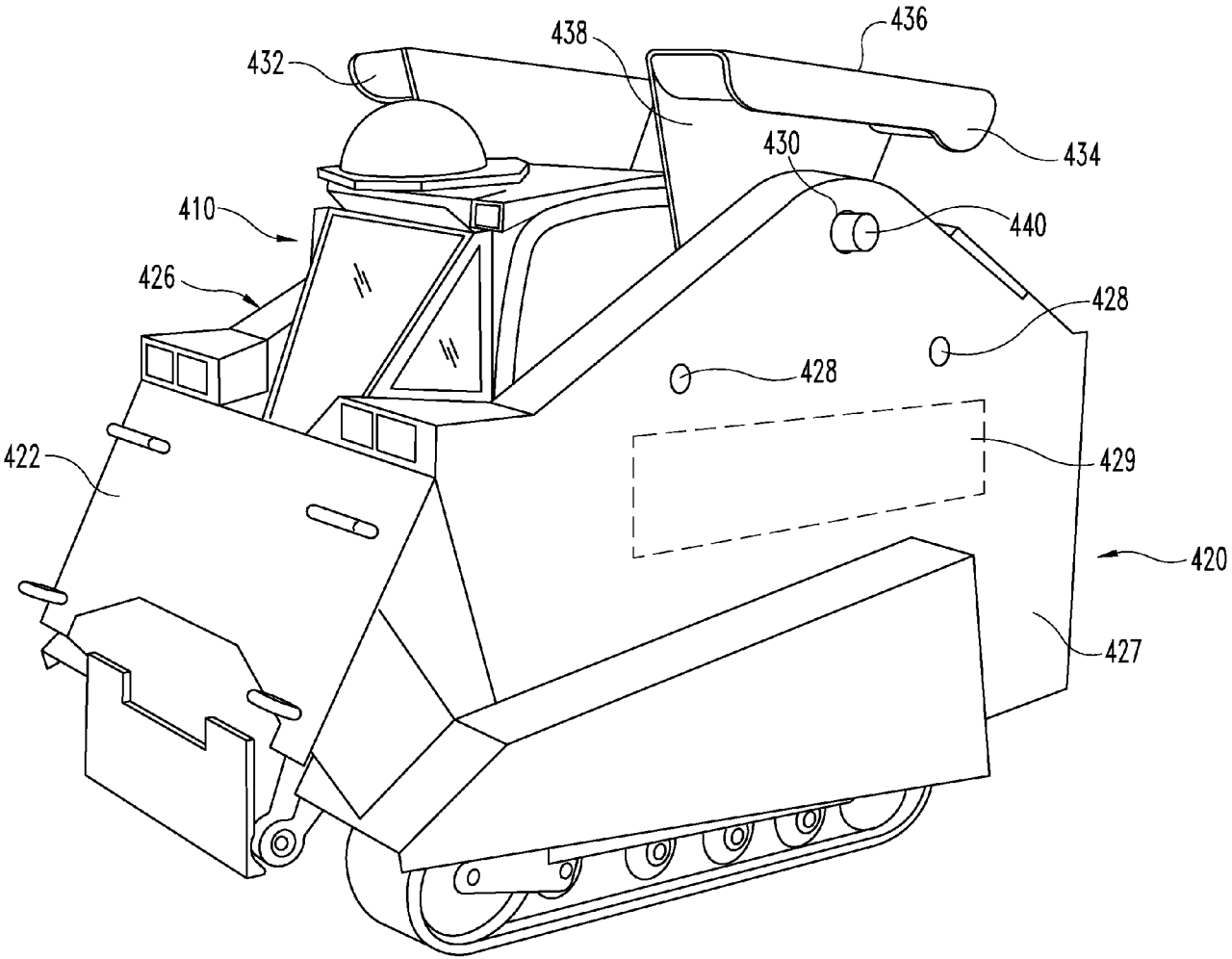
FIG. 25 is a perspective view of the FIG. 24 embodiment of the modified track loader and the armored helmet assembly.

Another example of a modified daily task machine (MDTM) or a modified compact track loader 410 is illustrated in FIGS. 24 and 25. The modified compact track loader 410 is similar to the modified track loader 100; therefore, similar features will not be discussed in detail. In this form, one embodiment of an armored helmet assembly 420 and one embodiment of a command surveillance module 450 are mounted on the compact track loader 410 as shown in FIG. 24.

The armored helmet assembly 420 is similar to the armored helmet assembly 120 although slightly modified as described next. The armored helmet assembly 420 includes a front panel 422, a back panel 424, a right side panel 426, and a left side panel 427. The right side panel 426 is similar to the left side panel 427; therefore, for the sake of brevity similar features will not be described. The left side panel 427 includes a pair of pin holes 428 and an opening 430. Each of the pin holes 428 is sized to receive a pin (not illustrated) to attach the armored helmet assembly 420 to the modified compact track loader 410. The left side panel 427 includes a designated attachment area 429 that is configured to receive various types of equipment such as weapons, equipment racks, and sensors, to name a few. In one form, the designated attachment area 429 includes one or more openings and one or more clips or other mechanisms configured to receive and hold various types of equipment (not illustrated).

The armored helmet assembly 420 also includes a right adjustment platform 432 that is locked or attached to the right side panel 426 and a left adjustment platform 434 that is locked or attached to the left side panel 427. In the illustrated embodiment, the right adjustment platform 432 is similar to the left adjustment platform 434. As shown, the left adjustment platform 434 has an "L" shape; however, the left adjustment platform 434 can have other shapes as desired. As such, the left adjustment platform 434 includes a horizontal plate portion 436 that extends to a vertical plate portion 438. The horizontal plate portion 436 is sized to receive the command surveillance module 450 as described in more detail below. In the illustrated embodiment, the vertical plate portion 438 includes a bar 440 that is sized and configured to extend through an opening 430 in the left side panel 427 to attach the left adjustment platform 434 to the left side panel 427. In other forms, the left side panel 427 and the vertical plate portion 438 are configured differently to attach the left adjustment platform 434 to the left side panel 427. The right and left adjustment platforms 432 and 434 can also be unlocked and removed from the right and left side panels 426 and 427.

Figure 26:
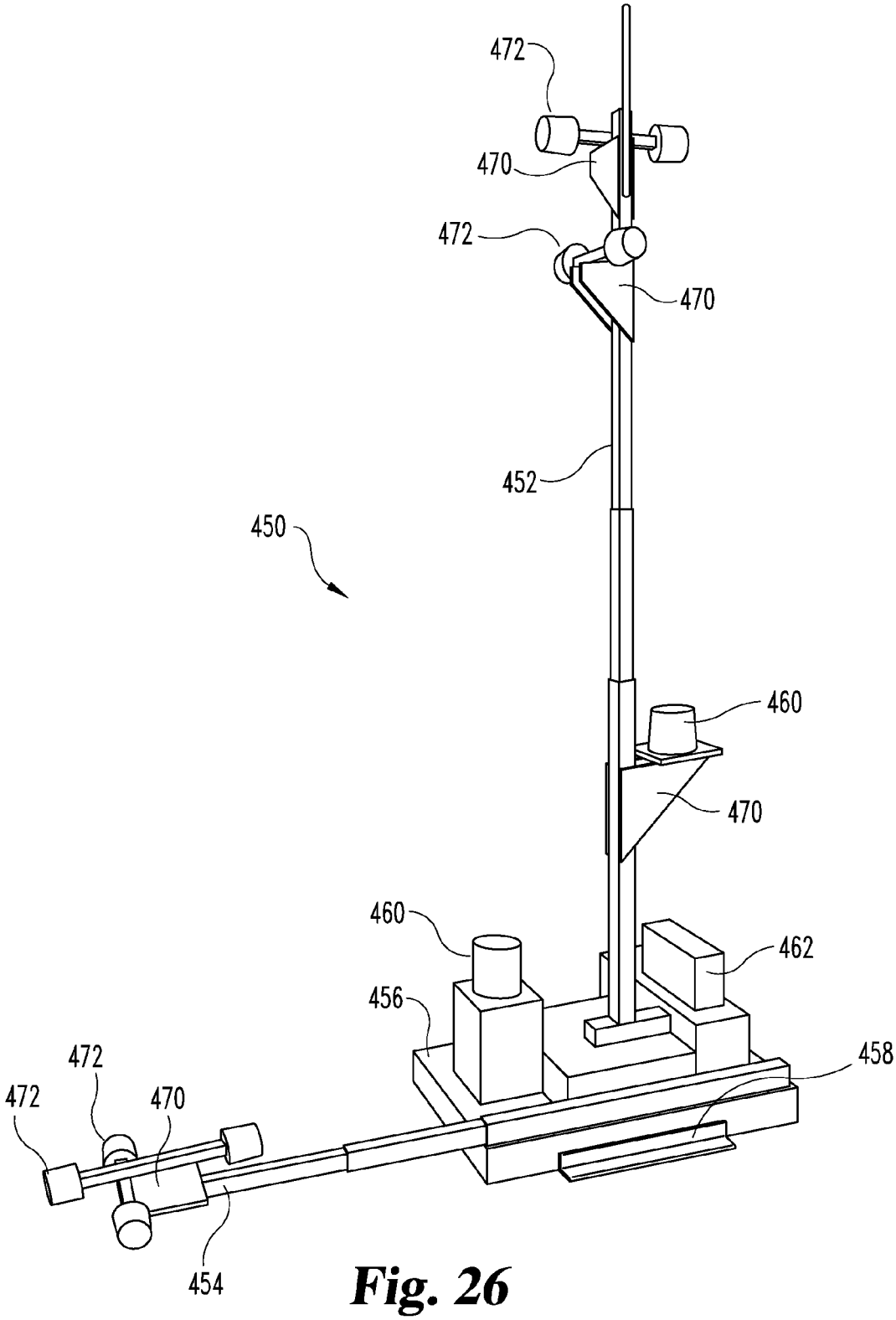
FIG. 26 is a perspective view of the FIG. 24 embodiment of the command surveillance module.

The command surveillance module 450 is illustrated in FIGS. 24 and 26. The command surveillance module 450 includes a telescopic vertical tower 452 and a telescopic horizontal arm 454. The telescopic vertical tower 452 and the telescopic horizontal arm 454 are configured similarly. The command surveillance module 450 also includes a base 456 that is sized to rest on both of the horizontal plate portions 436 of the right and left adjustment platforms 432 and 434. The telescopic vertical tower 452 and the telescopic horizontal arm 454 are mounted to the base 456.

The base 456 includes a pair of locking mounts 458 that are configured to engage the horizontal plate portion 436 of the right and left adjustment platforms 432 and 434. In this form, the pair of locking mounts 458 have an "L" shape; however, the locking mounts 458 can have another shape as desired. Optionally the base 456 includes a radar detector 460 and a battery 462 that is connected to the electrical equipment mounted on the command surveillance module 450. In one form, the battery 462 includes a generator that provides electrical power to the radar detector 460 and other equipment mounted on the command surveillance module 450.

The length of telescopic vertical tower 452 is adjustable as desired. In one configuration, the telescopic vertical tower 452 is made of a series of telescopic portions wherein a first portion slides within a subsequent second portion to increase or decrease the cumulative length of the telescopic vertical tower 452. Another configuration includes the telescopic vertical tower 452 made of a series legs that are connected together to form a desired overall length of telescopic vertical tower 452. The telescopic vertical tower 452 also includes one or more stations 470 that are configured to receive and retain various types of equipment. The stations 470 can be configured the same or uniquely as desired. For example, in the illustrated embodiment, one of the stations 470 is configured to receive a radar detector 460 and two of the stations 470 are each configured to receive a surveillance camera 472. Moreover, additional stations 470 can be added to the telescopic vertical tower 452 and likewise one or more stations 470 can be removed from the telescopic vertical tower 452. In the illustrated embodiment, the extended height of the telescopic vertical tower 452 and position of one or both of the cameras 472 mounted thereon are beneficial to enable the operator of the track loader 410 to view potential threats and terrain at a higher elevation from a safe elevation below and distance away.

The telescopic horizontal arm 454 is configured to extend a distance to increase the horizontal distance or reach of the telescopic horizontal arm 454. Similar to the telescopic vertical tower 452, the telescopic horizontal arm 454 also includes one or more stations 470 that are configured to receive and retain various types of equipment. A desired number of stations 470 can be added or removed from the telescopic horizontal arm 454. In the illustrated embodiment, the station 470 on the telescopic horizontal arm 454 is configured to receive two of the surveillance cameras 472.

Figure 27:
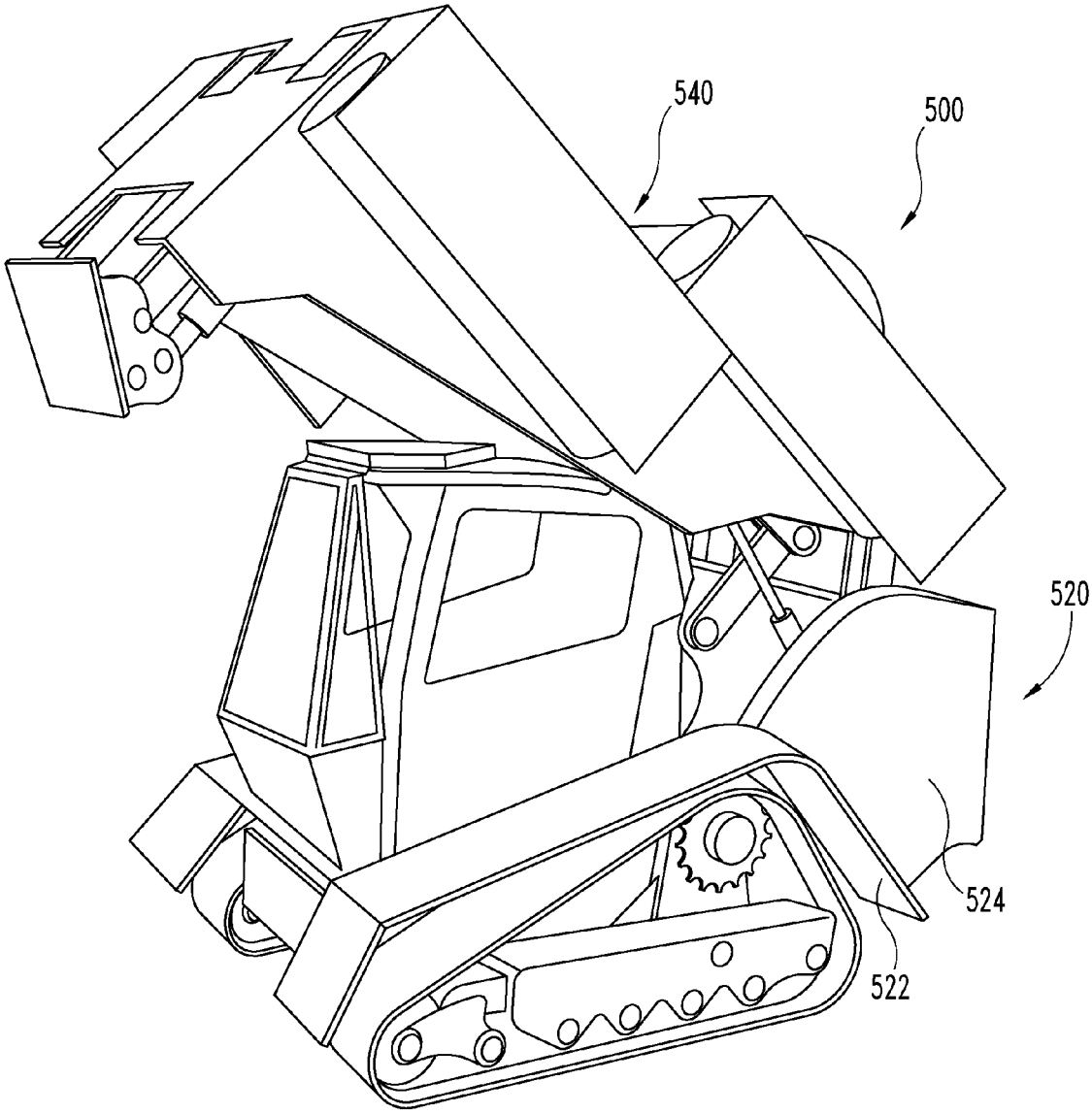
FIG. 27 is a perspective view of a modified compact track loader with one embodiment of a lower armored assembly and one embodiment of an upper armored helmet assembly.
Figure 28:
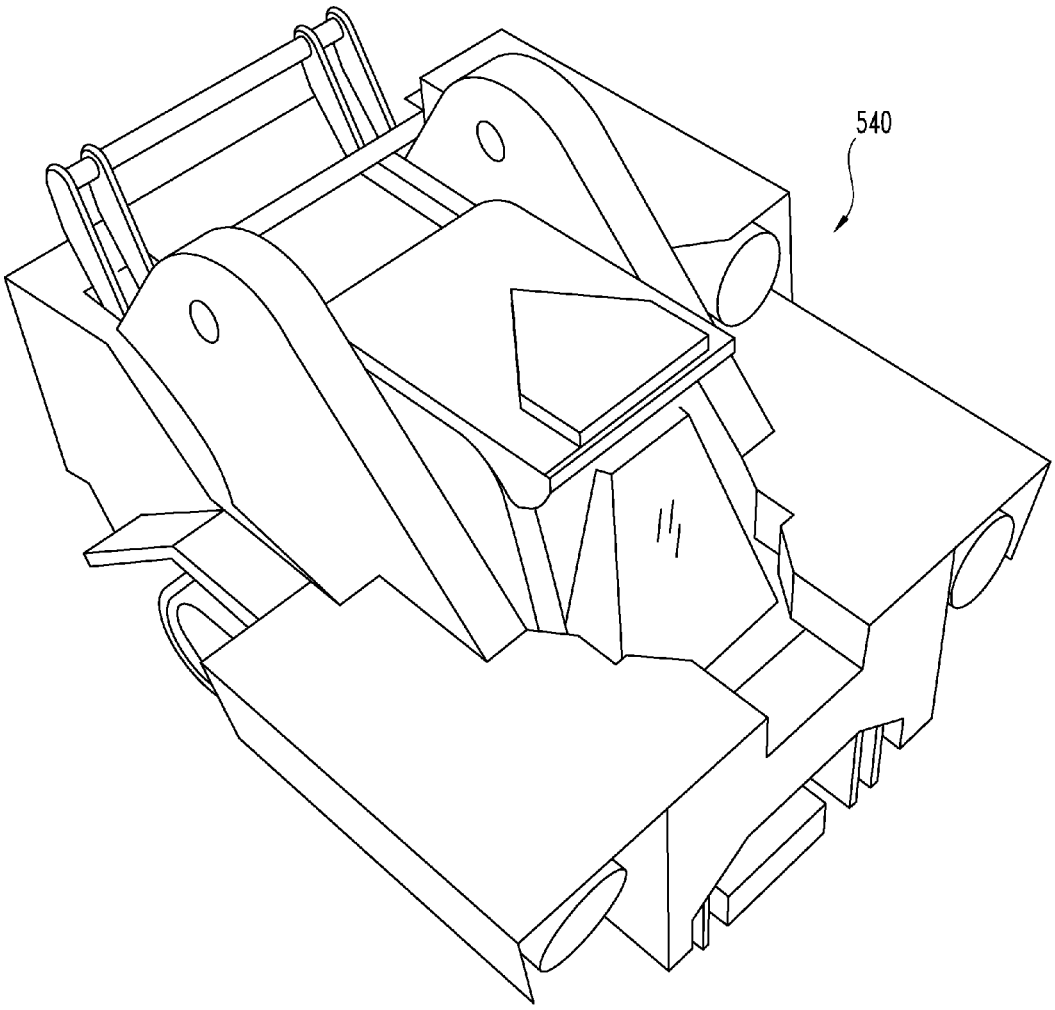
FIG. 28 is a top perspective view of the FIG. 27 embodiment with the upper armored helmet assembly in a lowered configuration.
Figure 29:
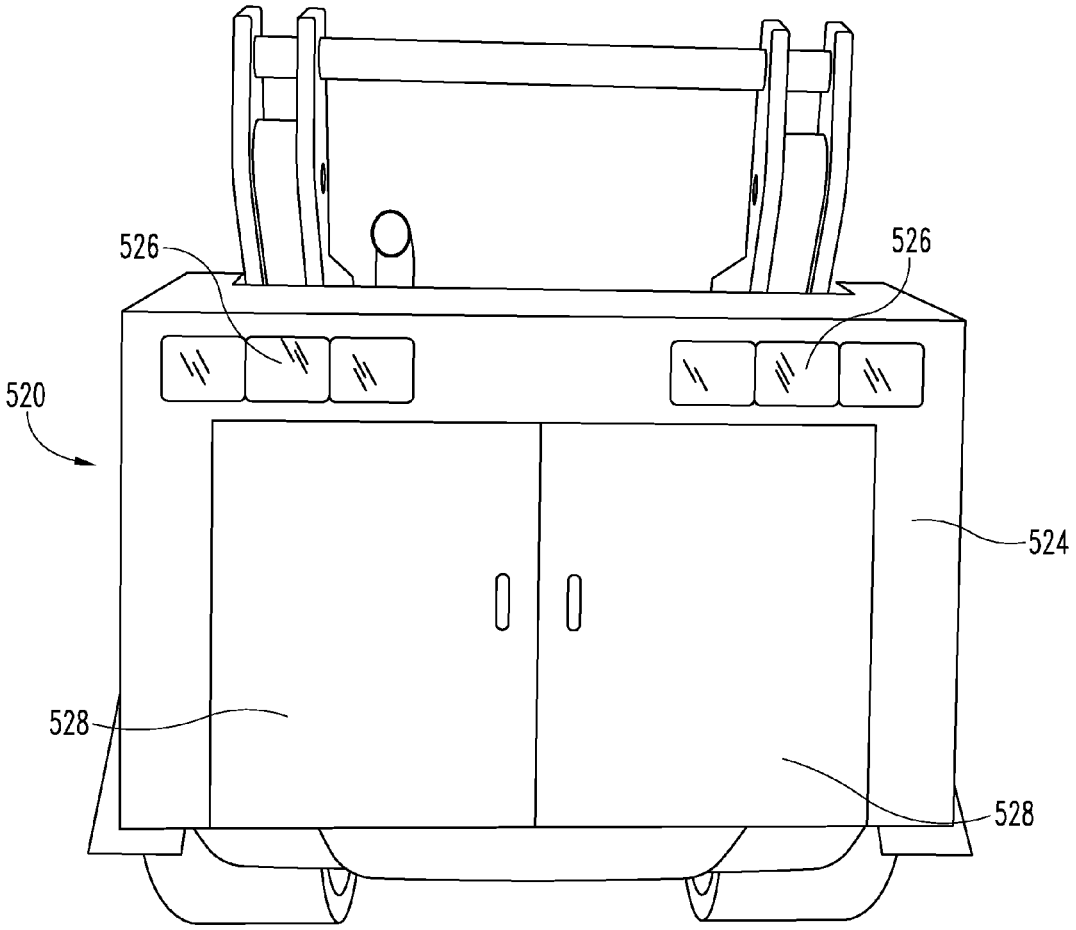
FIG. 29 is a rear view of the FIG. 27 embodiment.
Figure 30:
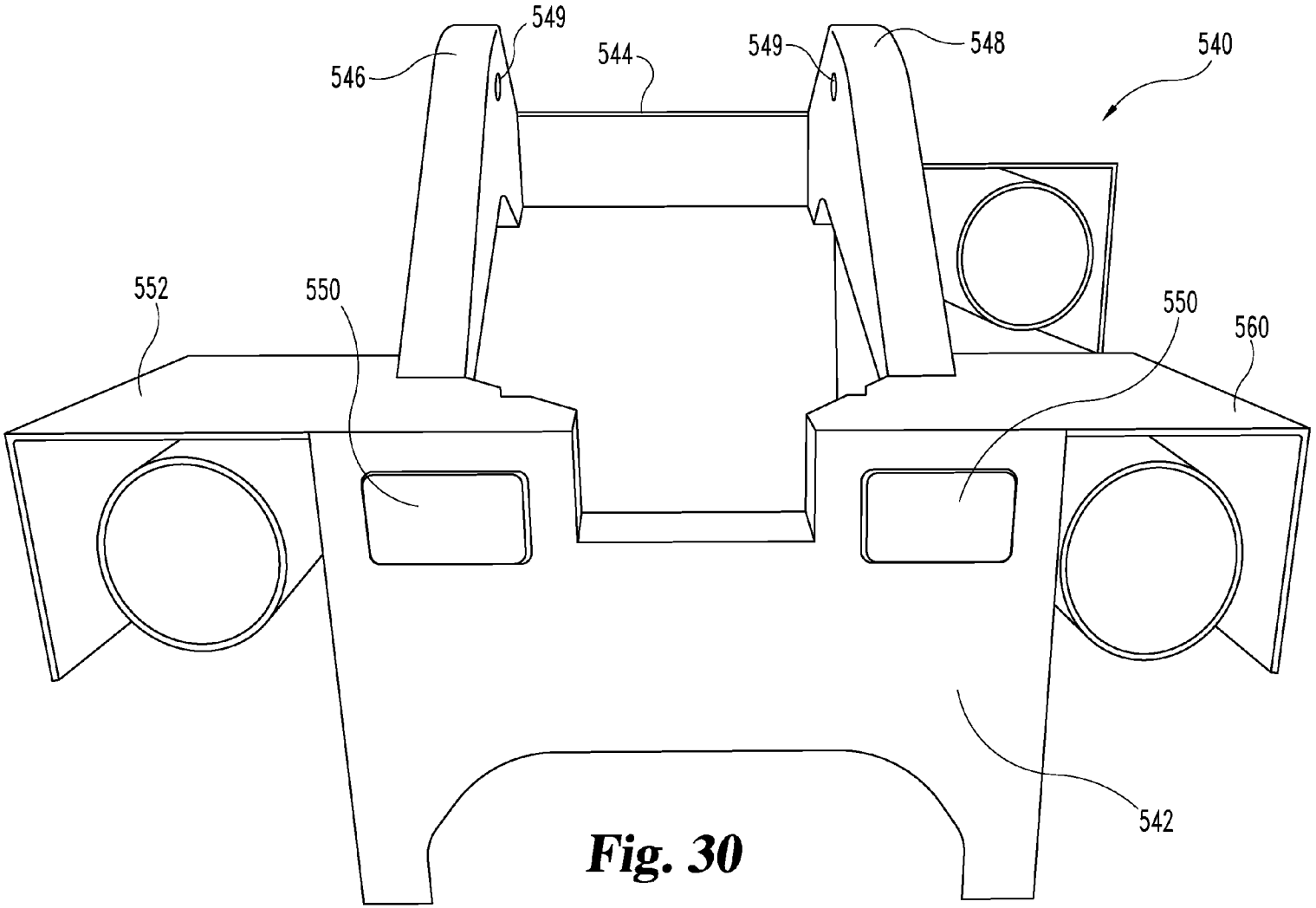
FIG. 30 is a front perspective view of an upper armored helmet assembly according to one embodiment.
Figure 31:
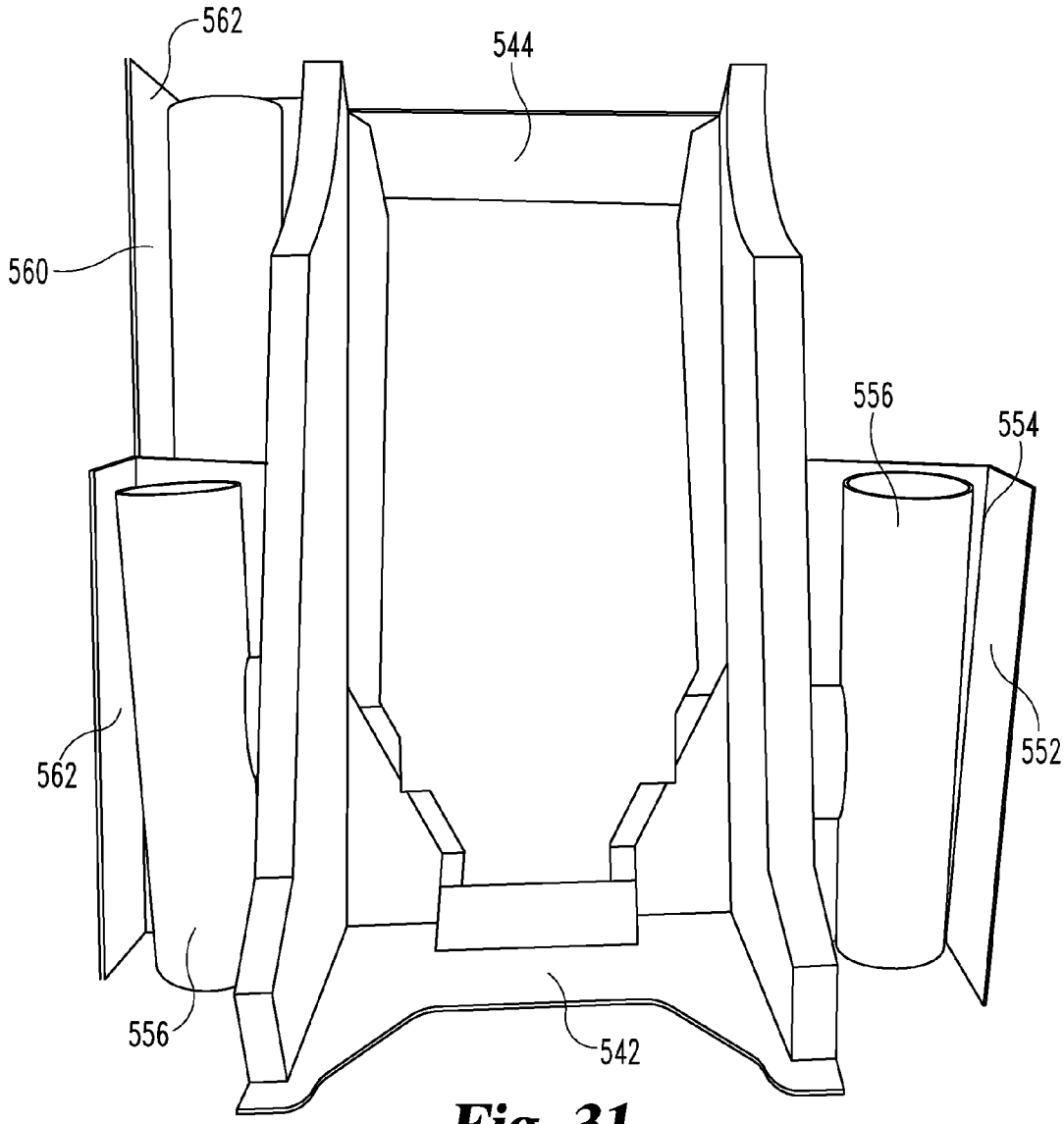
FIG. 31 is a bottom view of the FIG. 30 upper armored helmet assembly.

Yet another example of a modified daily task machine (MDTM) or a modified compact track loader 500 is illustrated in FIGS. 27, 28, and 29. The modified compact track loader 500 is similar to the modified track loader 100; therefore, similar features will not be discussed in detail. This example of a modified compact track loader 500 is similar to a Caterpillar 299C compact track loader. In this embodiment, a lower armored assembly 520 and an upper armored helmet assembly or protective shell 540 can be mounted to loader 500 as two separate assemblies.

Figure 32:
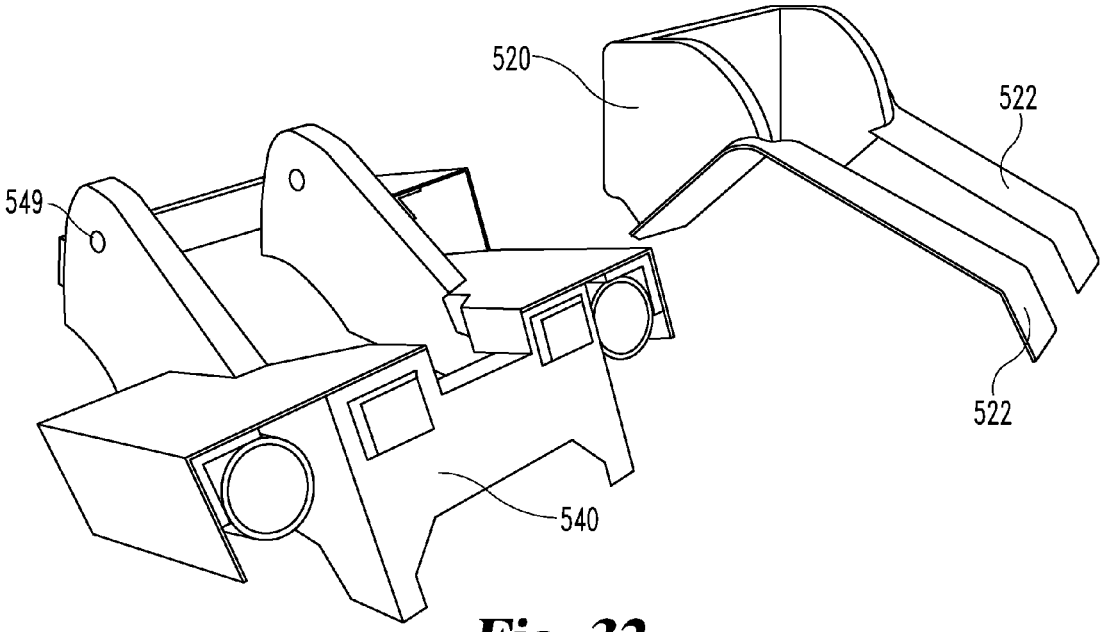
FIG. 32 is a perspective view of one embodiment of a lower armored assembly and one embodiment of an upper armored helmet assembly.

One form of a lower armored assembly 520 is illustrated in FIGS. 29 and 32. The lower armored assembly 520 is connectable to the modified compact track loader 500. The lower armored assembly 520 includes a pair of armor-plated track covers 522 that are each sized to cover one of the tracks. In other embodiments, the covers 522 can be configured differently to cover more or less of the tracks. In the present embodiment, the lower armored assembly 520 includes a rear storage compartment 524. In other embodiments, the lowered armored assembly 520 includes a solid rear wall without a storage compartment. The rear storage compartment 524 has a pair of lights 526 mounted at the top of the compartment 524. The rear storage compartment 524 includes a pair of doors 528 for access to the interior of the compartment 524.

One form of an upper armored helmet assembly 540 is illustrated in FIGS. 27, 28, 30, 31, and 32. The upper armored helmet assembly 540 is similar to armored helmet assembly 120 although modified to work with lower armored assembly 520 in two pieces rather than as one piece. The upper armored helmet assembly 540 includes a front panel 542, a back panel 544, a right side panel 546, and a left side panel 548. The right side panel 546 and the left side panel 548 each define a hole 549 that is shaped to receive a portion of the RWP assembly 150. In another embodiment, the panels 542, 544, 546, and 548 are arranged and configured to form a base upon which a RWP assembly 150 is mounted.

Preferably the front panel 542 includes a plurality of lights 550. In the illustrated embodiment, the right side panel 546 includes a housing 552 that has one compartment 554. The compartment 554 is sized to receive a rocket launcher 556. The rocket launcher 556 is similar to rocket launcher 140. Also in this embodiment, the left side panel 548 includes a housing 560. The housing 560 has a pair of compartments 562, each of the compartments 562 is sized to receive a rocket launcher 556. In other embodiments, the right side panel 546 and the left side panel 548 are configured to hold other types of firepower as discussed previously.

In other embodiments, the modified compact track loader 500 includes other attachments such as a battle shield or a front end attachment, to name a few. The lower armored assembly 520 and the upper armored helmet assembly 540 can each be suspended from a rack system 400, crane, boat, or another vehicle as described previously. Moreover, the lower armored assembly 520 and the upper armored helmet assembly 540 are each lowered onto and connected to the track loader 500. The lower armored assembly 520 and the upper armored helmet assembly 540 can also be loaded onto a truck and transported to the modified compact track loader 500 and assembled on-site.

In some embodiments, the modified track loader 100 or the modified compact track loader 500 include a system which allows the loader 100 or 500 to be controlled remotely so that loader 100 or 500 is un-manned or without an operator in the cockpit. In other embodiments, loader 100 or 500 is configured such that the loader 100 or 500 is controlled by robots.

While the invention has been illustrated and described in detail in the drawings and foregoing description, the same is to be considered as illustrative and not restrictive in character, it being understood that only the preferred embodiment has been shown and described and that all equivalents, changes, and modifications that come within the spirit of the inventions as described herein and/or by the following claims are desired to be protected.

What is claimed is:

1. An armored assembly for mounting on a host vehicle, comprising:

the host vehicle having an upper body and a lower body, the upper body defining a compartment for an operator of the host vehicle, the lower body including a drive mechanism configured to move the host vehicle; and an armored helmet assembly detachably mounted to the upper body, the armored helmet assembly configured as a completed assembly, the armored helmet assembly including:

a front panel opposite a back panel; and a right side panel opposite a left side panel, the right and left side panels span between the front and the back panels, wherein the front, back, right side, and left side panels are arranged to cover the compartment of the upper body.

2. The assembly of claim 1, wherein the compartment of the upper body includes a viewing area and the front panel is configured to surround the viewing area.

3. The assembly of claim 1, further comprising:

the host vehicle includes a pair of moveable arms; and the right and left side panels are configured to cover the moveable arms of the host vehicle.

4. The assembly of claim 3, further comprising:

wherein each of the arms of the host vehicle includes a pair of pin receivers;

wherein the right side panel and the left side panel each include a pair of pin receptacles; and a lug pin configured to connect the pin receptacle to the pin receiver to attach the right and left side panels of the armored helmet assembly to the pair of arms of the host vehicle.

5. The assembly of claim 4, wherein each of the pin receivers includes a pin keeper configured to cover and retain the lug pin in the pin receptacle and the pin receiver.

6. The assembly of claim 1, further comprising:

a weapon; and at least one of the left side panel or the right side panel includes a housing constructed and arranged to retain the weapon.

7. The assembly of claim 1, further comprising:

a rocket launcher; and at least one of the left side panel or the right side panel includes a bracket configured to retain the rocket launcher.

8. The assembly of claim 1, further comprising:

a plurality of rings arranged on the front and back panels, each of the plurality of rings is sized to receive one or more devices that are configured to suspend the armored helmet assembly therefrom.

9. The assembly of claim 1, further comprising:

a lower armored assembly detachably mounted to the lower body of the host vehicle, the lower armored assembly configured as a completed assembly that covers the drive mechanism of the lower body.

* * * * *